US010448715B2

(12) United States Patent
Tung

(10) Patent No.: US 10,448,715 B2
(45) Date of Patent: Oct. 22, 2019

(54) MODULAR UMBRELLA

(71) Applicant: Benson Tung, Kaohsiung (TW)

(72) Inventor: Benson Tung, Kaohsiung (TW)

( * ) Notice: Subject to any disclaimer, the term of this patent is extended or adjusted under 35 U.S.C. 154(b) by 28 days.

(21) Appl. No.: 15/874,923

(22) Filed: Jan. 19, 2018

(65) Prior Publication Data

US 2019/0226229 A1 Jul. 25, 2019

(51) Int. Cl.

| | |
|---|---|
| ***A45B 25/02*** | (2006.01) |
| ***A45B 25/14*** | (2006.01) |
| ***A45B 25/06*** | (2006.01) |
| ***E04H 15/28*** | (2006.01) |

(52) U.S. Cl.

CPC ..... *A45B 25/02* (2013.01); *A45B 25/06* (2013.01); *A45B 25/14* (2013.01); *E04H 15/28* (2013.01)

(58) Field of Classification Search

CPC ..... A45B 25/02; A45B 23/00; A45B 25/00; A45B 25/06; A45B 25/10; A45B 25/14; A45B 2025/146; A45B 17/00; E04H 15/28; E04H 15/48

USPC ..... 135/16, 98, 20.3, 28–32

See application file for complete search history.

(56) References Cited

U.S. PATENT DOCUMENTS

| | | | | | |
|---|---|---|---|---|---|
| 878,270 | A * | 2/1908 | Blake et al. | A45B 25/06 | 135/28 |
| 2,101,510 | A * | 12/1937 | Rathbun | A45B 25/06 | 135/28 |
| 4,368,749 | A * | 1/1983 | Lindler | A45B 25/02 | 135/15.1 |
| 5,020,557 | A * | 6/1991 | Apple | A45B 23/00 | 135/15.1 |
| 5,085,239 | A * | 2/1992 | Chin-Hung | A45B 25/18 | 135/25.33 |
| 6,386,215 | B1 * | 5/2002 | Chang | A45B 23/00 | 135/20.3 |
| 6,889,699 | B2 * | 5/2005 | Clarke | A45B 23/00 | 135/20.3 |
| 7,082,953 | B2 * | 8/2006 | Liu | A45B 25/08 | 135/28 |
| 7,318,444 | B2 * | 1/2008 | Clarke | A45B 25/06 | 135/28 |
| 9,113,683 | B2 * | 8/2015 | Ma | A45B 25/08 | |
| 9,271,551 | B2 * | 3/2016 | Ma | A45B 25/02 | |
| 9,301,581 | B1 * | 4/2016 | Su | A45B 25/22 | |
| 2010/0139725 | A1 * | 6/2010 | Lai | A45B 25/02 | 135/29 |

* cited by examiner

*Primary Examiner* — Winnie Yip

(74) *Attorney, Agent, or Firm* — Alan D. Kamrath; Karin L. Williams; Mayer & Williams PC

(57) ABSTRACT

A modular umbrella includes a fixed hub device mounted on a top end of a post and a runner device slideably mounted to the post. The fixed hub device is detachably coupled with four, six, or eight rib seats for coupling with a corresponding number of ribs. A corresponding number of stretchers is detachably mounted between the ribs and the rib seats. Thus, the modular umbrella can be assembled to include four, six, or eight ribs and can be arranged to support a square or rectangular canopy.

10 Claims, 24 Drawing Sheets

MODULAR UMBRELLA

BACKGROUND OF THE INVENTION

The present invention relates to an umbrella and, more particularly, to a modular umbrella having a variable number of ribs according to needs.

Umbrellas are used to shield from rainwater or sunlight and generally include a plurality of pivotal ribs and a canopy mounted on the pivotal ribs. A runner is slideably mounted on a post of the umbrella. A plurality of stretcher ribs is mounted between the runner and the ribs. When the runner slides vertically along the post, the stretchers are moved to pivot the ribs for folding or unfolding the canopy.

The number of the ribs for umbrellas is selected according to different factors, such as the needs, functions, overall weight, price, etc. For example, an umbrella can include four, six, eight, or a different number of ribs and a corresponding number of stretchers. An umbrella with a larger number of ribs possesses better wind resistance, yet the overall weight and the overall volume are increased, resulting in an increase in the cost. On the other hand, an umbrella with a smaller number of ribs has a smaller overall weight and a smaller overall volume and, thus, has a lower price.

Manufacturers have to produce a corresponding number of fixed rub devices for pivotal connection with the ribs and a corresponding number of runner devices according to the number of the ribs and then have to troublesomely assemble each respective fixed rub device and the associated runner device, resulting in an increase in the cost.

BRIEF SUMMARY OF THE INVENTION

In a further aspect, a modular umbrella includes a post having a top end. An upper coupling sleeve is fixed on the top end of the post. The upper coupling sleeve includes a plurality of first upper positioning grooves spaced from each other in a circumferential direction about a longitudinal axis of the post. A plurality of rib seats is provided. Each of the plurality of rib seats includes a first engaging portion and an upper lug. Some or all of the plurality of rib seats are selected and detachably couple with the upper coupling sleeve. The first engaging portion of each of the selected ones of the plurality of rib seats engages with a respective one of the plurality of first upper positioning grooves of the upper coupling sleeve. The selected ones of the plurality of rib seats is spaced from each other in the circumferential direction about the longitudinal axis of the post. A plurality of ribs is provided. Each of the plurality of ribs includes a pivotal end pivotably connected to the upper lug of a respective one of the selected ones of the plurality of rib seats. A lower coupling sleeve is slideably mounted on the post and is slideable along the longitudinal axis of the post. The lower coupling sleeve includes a plurality of first lower positioning grooves respectively aligned with the plurality of first upper positioning grooves. The number of the plurality of first lower positioning grooves is equal to the number of the plurality of first upper positioning grooves. A plurality of stretcher seats is provided. Each of the plurality of stretcher seats includes a first positioning portion and a lower lug. Some or all of the plurality of stretcher seats are selected and detachably couple with the lower coupling sleeve. The number of the selected ones of the plurality of stretcher seats is equal to the number of the selected ones of the plurality of rib seats. The first positioning portion of each of the selected ones of the plurality of stretcher seats engages with a respective one of the plurality of first lower positioning grooves. The selected ones of the plurality of stretcher seats are spaced from each other in the circumferential direction about the longitudinal axis of the post and are respectively aligned with the selected ones of the plurality of rib seats. A plurality of stretchers is provided. Each of the plurality of stretchers includes a first pivotal end and a second pivotal end. The first pivotal end of each of the plurality of stretchers is pivotably connected to a respective one of the plurality of ribs. The second pivotal end of each of the plurality of stretchers is pivotably connected to the lower lug of a respective one of the selected ones of the plurality of stretcher seats.

In an example, the upper coupling sleeve includes a first end face. The plurality of first upper positioning grooves is defined in the first end face of the upper coupling sleeve. The plurality of first upper positioning grooves includes a first groove, a plurality of second grooves, a plurality of third grooves, and a plurality of optional fourth grooves. The first groove and the plurality of second grooves are spaced from each other by a first annular regular interval. The first groove and the plurality of third grooves are spaced from each other by a second annular regular interval different from the first annular regular interval. The first groove and the plurality of optional fourth grooves are spaced from each other by a third annular regular interval different from the first and second annular regular intervals. The lower coupling sleeve includes a top end face. The plurality of first lower positioning grooves is defined in the top end face of the lower coupling sleeve.

In an example, the first groove and the plurality of second grooves are spaced from each other by 90°. The first groove and the plurality of third grooves are spaced from each other by 60°. The first groove and the plurality of optional fourth grooves are spaced from each other by 45°. One of the plurality of second grooves spaced from the first groove by 180° is also one of the plurality of third grooves spaced from the first groove by 180° and is also one of the plurality of fourth grooves spaced from the first groove by 180°. Another one of the plurality of second grooves spaced from the first groove by 90° is also another one of the plurality of fourth grooves spaced from the first groove by 90°. A further one of the plurality of second grooves spaced from the first groove by 270° is also a further one of the plurality of fourth grooves spaced from the first groove by 270°.

In an example, the upper coupling sleeve further includes a second end face spaced from the first end face along the longitudinal axis of the post. The upper coupling sleeve further includes a plurality of second upper positioning grooves defined in the second end face. The number of the plurality of second upper positioning grooves is equal to the number of the first upper positioning grooves. Each of the plurality of rib seats further includes a second engaging portion. The second engaging portion of each of the selected ones of the plurality of rib seats engages with a respective one of the plurality of second upper positioning grooves. The lower coupling sleeve further includes a bottom end face spaced from the top end face along the longitudinal axis of the post. The lower coupling sleeve further includes a plurality of second lower positioning grooves defined in the bottom end face and respectively aligned with the plurality of first lower positioning grooves. The number of the plurality of second lower positioning grooves is equal to the number of the plurality of first lower positioning grooves. Each of the plurality of stretcher seats further includes a second positioning portion. The second positioning portion of each of the selected ones of the plurality of stretcher seats engage with a respective one of the plurality of second lower positioning grooves.

In an example, the first engaging portion of each of the plurality of rib seats includes a first portion and a second portion larger than the first portion. The upper coupling sleeve further includes a coupling groove defined in the first end face and intercommunicating with the plurality of first upper positioning grooves. The first portion of each of the selected ones of the plurality of rib seats is received in a respective one of the plurality of first upper positioning grooves. The second portion of each of the selected ones of the plurality of rib seats is received in the coupling groove. The first positioning portion of each of the plurality of stretcher seats includes a narrower portion and a wider portion that is larger than the narrower portion. The lower coupling sleeve includes an insertion groove defined in the top end face and intercommunicating with the plurality of first lower positioning groove. The narrower portion of each of the selected ones of the plurality of stretcher seats is received in a respective one of the plurality of first lower positioning grooves. The wider portion of each of the selected ones of the plurality of stretcher seats is received in the insertion groove.

In an example, the modular umbrella further includes a first upper fixing member, a second upper fixing member, a first lower fixing member, and a second lower fixing member. Each of the plurality of rib seats further includes a base having an inner surface on which the first engaging portion is disposed and an outer surface on which the upper lug is disposed. The upper coupling sleeve includes a first end face and a second end face. The first upper fixing member is fixed on the first end face and secures a top end of the base of each of the selected ones of the plurality of rib seats. The second upper fixing member is fixed on the second end face of the upper coupling sleeve and secures a lower end of the base of each of the selected ones of the plurality of rib seats. Each of the plurality of stretchers seats further includes a body having an inner side on which the first positioning portion is disposed and an outer side on which the lower lug is disposed. The lower coupling sleeve includes a top end face and a bottom end face. The first lower fixing member is fixed on the top end face of the lower coupling sleeve and secures a top end of the body 111 of each of the selected ones of the plurality of stretcher seats. The second lower fixing member is fixed on the bottom end face of the lower coupling sleeve and secures a bottom end of the body of each of the selected ones of the plurality of stretchers seats.

In an example, the modular umbrella further includes a plurality of connecting members. Each of the plurality of connecting members includes a first engaging portion, a second engaging portion, and an intermediate portion between the first engaging portion and the second engaging portion. The first engaging portion of each of the plurality of connecting members receives a respective one of the plurality of ribs. The second engaging portion of each of the plurality of connecting members is pivotably connected to the first pivotal end of a respective one of the plurality of stretchers. A plurality of first engaging screws is provided. Each of the plurality of engaging screws is detachably coupled to the first engaging portion of a respective one of the plurality of connecting members and fixes a respective one of the plurality of ribs to the first engaging portion. A plurality of second engaging screws is provided. Each of the plurality of second engaging screws is detachably coupled to the second engaging portion of a respective one of the plurality of connecting members and pivotably connects the first pivotal end of a respective one of the plurality of stretchers to the second engaging portion.

In another aspect, a modular umbrella includes a post having a top end. A fixed hub device is fixed on the top end of the post. The fixed hub device includes a plurality of rib seats, a first upper fixing member, and a second upper fixing member spaced from the first upper fixing member along a longitudinal axis of the post. At least one of the first upper fixing member and the second upper fixing member is detachably mounted. Some or all of the plurality of rib seats are selected and detachably mounted between the first upper fixing member and the second upper fixing member. A plurality of ribs is provided. Each of the plurality of ribs is pivotably connected to a respective one of the selected ones of the plurality of rib seats. A runner device is mounted on the post and is slideable along the longitudinal axis of the post. The runner device includes a plurality of stretcher seats, a first lower fixing member, and a second lower fixing member spaced from the first lower fixing member along the longitudinal axis of the post. At least one of the first lower fixing member and the second lower fixing member is detachably mounted. Some or all of the plurality of stretcher seats are detachably mounted between the first lower fixing member and the second lower fixing member. The number of the selected ones of the plurality of stretcher seats is equal to the number of the selected ones of the plurality of rib seats. A plurality of stretchers is provided. Each of the plurality of stretchers includes a first pivotal end and a second pivotal end. The first pivotal end of each of the plurality of stretchers is pivotably connected to a respective one of the plurality of ribs. The second pivotal end of each of the plurality of stretchers is pivotably connected to a respective one of the selected ones of the plurality of stretcher seats.

In an example, the fixed hub device further includes an upper coupling sleeve fixed on the top end of the post. The upper coupling sleeve includes a first end face and a second end face. Each of the plurality of rib seats further includes a base. The first upper fixing member is fixed on the first end face and secures a top end of the base of each of the selected ones of the plurality of rib seats. The second upper fixing member is fixed on the second end face of the upper coupling sleeve and secures a bottom end of the base of each of the selected ones of the plurality of rib seats. The runner device further includes a lower coupling sleeve having a top end face and a bottom end face. Each of the plurality of stretcher seats further includes a body. The first lower fixing member is fixed on the top end face of the lower coupling sleeve and secures a top end of the body of each of the selected one of the plurality of stretcher seats. The second lower fixing member is fixed on the bottom end face of the lower coupling sleeve and secures a bottom end of the body of each of the selected ones of the plurality of stretchers seats.

The plurality of rib seats can include four, six, or eight rib seats spaced from each other by an annular regular interval.

In an example, the fixed hub device further includes two longer side ribs. Each of the two longer side ribs has a length smaller than a length of each of the plurality of ribs. The fixed hub device includes an upper coupling sleeve fixed on the top end of the post. The upper coupling sleeve includes a plurality of first upper positioning grooves and four first upper fixing grooves spaced from the plurality of first upper positioning grooves in the circumferential direction about the longitudinal axis of the post. The plurality of first upper positioning grooves includes a first groove, a plurality of second grooves, a plurality of third grooves, and a plurality of fourth grooves. The first groove and the plurality of second grooves are spaced from each other by 90°. The first groove and the plurality of third grooves are spaced from each other by 60°. The first groove and the plurality of fourth grooves are spaced from each other by 45°. One of the plurality of second grooves spaced from the first groove by 180° is also one of the plurality of third grooves spaced from the first groove by 180° and is also one of the plurality of fourth grooves spaced from the first groove by 180°. Another one of the plurality of second grooves spaced from the first groove by 90° is also another one of the plurality of fourth grooves spaced from the first groove by 90°. A further one of the plurality of second grooves spaced from the first groove by 270° is also a further one of the plurality of fourth grooves spaced from the first groove by 270°. Each of the plurality of rib seats includes a first engaging portion on the base thereof. The first engaging portion of each of the selected ones of the plurality of rib seats engages with a respective one of the first upper positioning grooves of the upper coupling sleeve and/or four of the plurality of rib seats engage with the four first upper fixing grooves. The runner device includes a plurality of first lower positioning grooves respectively aligned with the plurality of first upper positioning grooves. The number of the plurality of first lower positioning grooves is equal to the number of the plurality of first upper positioning grooves. The runner device further includes four first lower fixing grooves spaced from the plurality of first lower positioning grooves in the circumferential direction of the longitudinal axis of the post and respectively aligned with the four first upper fixing grooves.

When four of the plurality of rib seats are selected and detachably engage with the first groove and the plurality of second grooves spaced from each other by 90°, four of the plurality of stretcher seats are selected and respectively and detachably couple with the first groove and the plurality of second grooves.

When six of the plurality of rib seats are selected and detachably engage with the first groove and the plurality of third grooves spaced from each other by 60°, six of the plurality of stretcher seats are selected and respectively and detachably couple with six of the plurality of first lower positioning grooves respectively aligned with the first groove and the plurality of third grooves.

When eight of the plurality of rib seats are selected and detachably engage with the first groove and the plurality of fourth grooves spaced from each other by 45°, eight of the plurality of stretcher seats are selected and respectively and detachably couple with eight of the plurality of first lower positioning grooves respectively aligned with the first groove and the plurality of fourth grooves.

When four of the plurality of rib seats are selected and detachably engage with the four first upper fixing grooves, four of the plurality of stretcher seats are selected and respectively and detachably couple with the four first lower fixing grooves.

When four of the plurality of rib seats are selected and detachably engage with the four first upper fixing grooves and another two of the plurality of rib seats are selected and detachably engage with two of the plurality of first upper positioning grooves, four of the plurality of stretcher seats are selected to respectively and detachably couple with the four first lower fixing grooves, another two of the plurality of stretcher seats are selected and respectively and detachably couple with two of the plurality of first lower positioning grooves aligned with the two of the plurality of first upper positioning grooves. The two longer side ribs are respectively and pivotably connected to the another two of the plurality of rib seats.

In another example, the modular umbrella further includes two shorter side ribs. Each of the two shorter side ribs has a length larger than the length of each of the two longer side ribs and shorter than the length of each of the plurality of ribs. Further two of the plurality of rib seats are selected and detachably engage with further two of the plurality of first upper positioning grooves. The two short side ribs are respectively and pivotably connected to the further two of the plurality of rib seats. Further two of the plurality of stretcher seats are selected and detachably engage with two of the four first lower fixing grooves that are aligned with the further two of the plurality of rib seats pivotably connected to the two shorter side ribs. Each of another two of the plurality of stretchers are respectively and pivotably connected between one of the two shorter side ribs and one of the further two of the plurality of stretcher seats.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
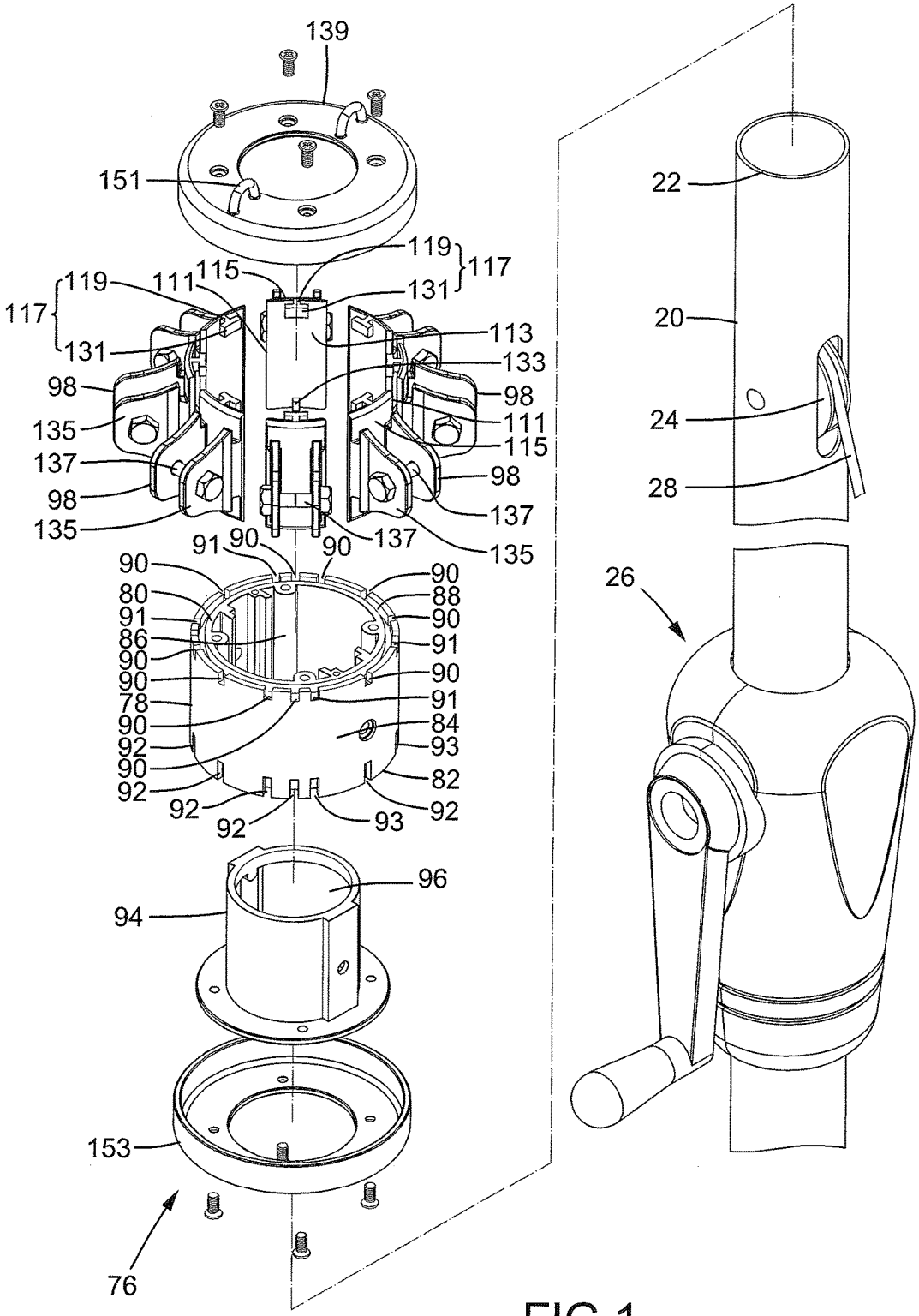
FIG. 1 is a partial, exploded, perspective view of a modular umbrella according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "top", "bottom", "inner", "outer", "side", "end", "portion", "longitudinal", "circumferential", "annular", "upward", "outward", "narrower", "wider", "longer", "shorter", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A modular umbrella according to the present invention is shown in the drawings and generally designated 10. The modular umbrella 10 includes a post 20 that is hollow. The post 20 includes a top end 22 and a roller 24 rotatably mounted to the post 20 and located adjacent to the top end 22. A cable winding device 26 is mounted below the roller 24 along a longitudinal axis of the post 20. A cable 28 has a first end attached to the cable winding device 26 and a second end extending upward and wound around the roller 24.

The umbrella 10 includes a fixed hub device 30 having an upper coupling sleeve 32 fixed on the top end 22 of the post 20. The upper coupling sleeve 32 includes a first coupling member 34 and a second coupling member 48. The first coupling member 34 includes a first end face 36, a second end face 38 located below the first end face 36 along the longitudinal axis of the post 20, and an outer periphery 39 extending between the first end face 36 and the second end face 38. The first coupling member 34 further includes an upper receiving hole 40 extending from the first end face 36 through the second end face 38 and spaced from the outer periphery 39. The first coupling member 34 further includes a plurality of first upper positioning grooves 44*a*-44*d* defined in the first end face 36 and spaced from each other in a circumferential direction about the longitudinal axis of the post 20. Each of the plurality of first upper positioning grooves 44*a*-44*d* extends to the outer periphery 39.

Figure 2:
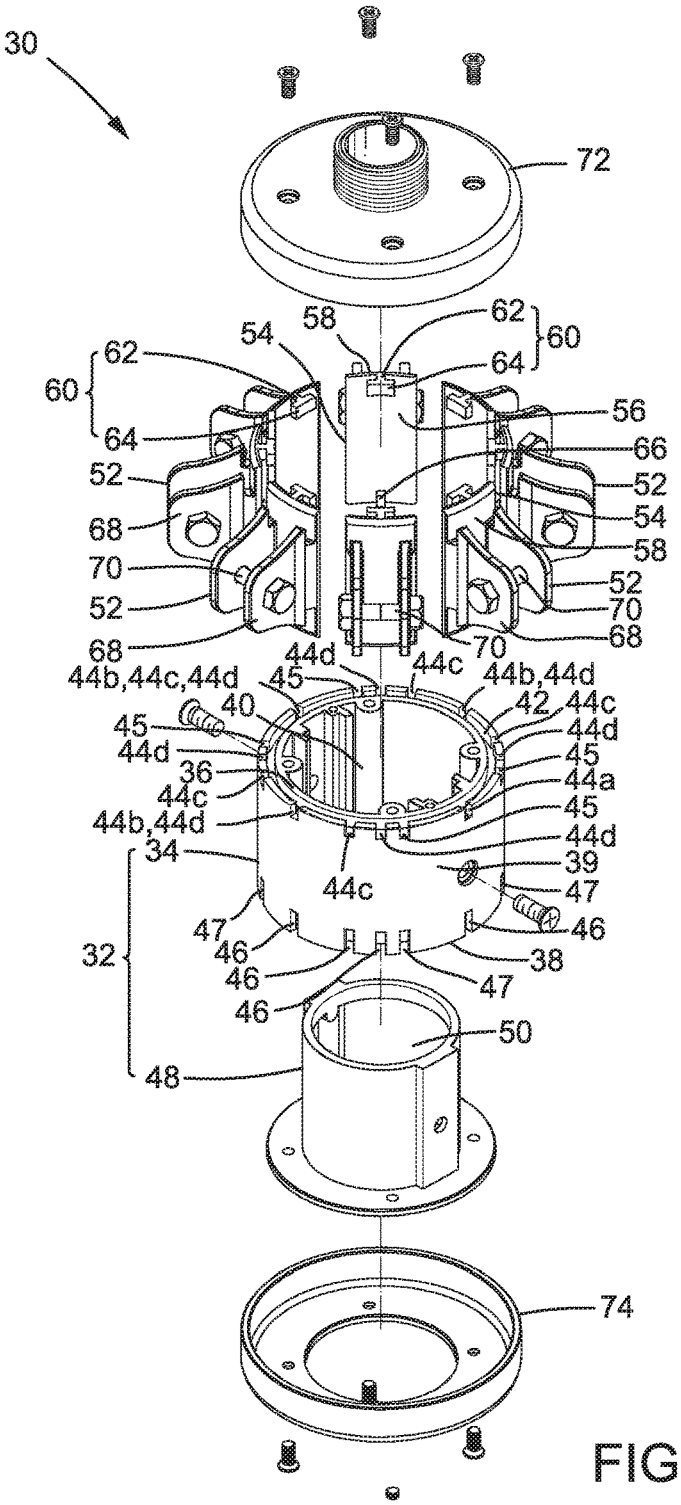
FIG. 2 is an exploded, perspective view of a fixed hub device of the modular umbrella of FIG. 1.

In an example, the plurality of first upper positioning grooves 44*a*-44*d* includes a first groove 44*a*, a plurality of second grooves 44*b*, a plurality of third grooves 44*c*, and a plurality of fourth grooves 44*d*. The first groove 44*a* and the plurality of second grooves 44*b* are spaced from each other by 90°. The first groove 44*a* and the plurality of third grooves 44*c* are spaced from each other by 60°. The first groove 44*a* and the plurality of fourth grooves 44*d* are spaced from each other by 45°. One of the plurality of second grooves 44*b* spaced from the first groove 44*a* by 180° is also one of the plurality of third grooves 44*c* spaced from the first groove 44*a* by 180° and is also one of the plurality of fourth grooves 44*d* spaced from the first groove 44*a* by 180°. Another one of the plurality of second grooves 44*b* spaced from the first groove 44*a* by 90° is also another one of the plurality of fourth grooves 44*d* spaced from the first groove 44*a* by 90°. A further one of the plurality of second grooves 44*b* spaced from the first groove 44*a* by 270° is also a further one of the plurality of fourth grooves 44*d* spaced from the first groove 44*a* by 270°. In the example shown in FIG. 2, the first coupling member 34 includes twelve first upper positioning grooves 44*a*-44*d*.

The first coupling member 34 further includes four first upper fixing grooves 45 spaced from the plurality of first upper positioning grooves 44*a*-44*d* in the circumferential direction about the longitudinal axis of the post 20. Two adjacent first upper fixing grooves 45 are spaced from each other by 113° or 67°. Furthermore, the first coupling member 34 includes four second upper fixing grooves 47 defined in the second end face 38 and respectively aligned with the four first upper fixing grooves 47.

The first coupling member 34 further includes a coupling groove 42 defined in the first end face 36 and intercommunicating with the plurality of first upper positioning grooves 44*a*-44*d* and the four first upper fixing grooves 45. In an example, the coupling groove 42 extends from the first end face 36 towards but spaced from the second end face 38 and is annular. The first coupling member 34 further includes a plurality of second upper positioning grooves 46 defined in the second end face 38. The number of the plurality of second upper positioning grooves 46 is equal to the number of the first upper positioning grooves 44*a*-44*d*. Furthermore, the first coupling member 34 includes four second upper fixing grooves 47 defined in the second end face 38 and respectively aligned with the four first upper fixing grooves 45.

The second coupling member 48 includes a coupling hole 50 having an inner diameter slightly larger than an outer diameter of the post 20. The second coupling member 48 is mounted in the upper receiving hole 40 of the first coupling member 34.

The fixed hub device 30 further includes a plurality of rib seats 52 selectively and detachably coupled with the upper coupling sleeve 32. Each of the plurality of rib seats 52 includes a base 54 having an inner surface 56 and an outer surface 58. Each of the plurality of rib seats 52 further includes two upper lugs 68 disposed on the outer surface 58 and first and second engaging portions 60 and 66 disposed on the inner surface 56. The inner engaging portion 60 includes a first portion 62 and a second portion 64 having a volume larger than a volume of the first portion 62. The second portion 64 is spaced from the inner surface 56 of the base 54.

Some or all of the plurality of rib seats 32 are selected and detachably couple with the upper coupling sleeve 32. In the example shown in FIGS. 4-6, eight of the plurality of rib seats 52 are selected to respectively align with the first groove 44*a* and the plurality of fourth grooves 44*d* spaced from each other by 45° (namely, eight first upper positioning grooves 44*a* and 44*d* in total). The first engaging portion 60 of each of the selected eight rib seats 52 engages with a respective one of the plurality of first upper positioning grooves 44*a* and 44*d* of the upper coupling sleeve 32, and the second engaging portion 66 of each of the selected eight rib seats 52 engages with a respective one of the plurality of second upper positioning grooves 46 (see FIGS. 5, 7, and 9). Specifically, the first portion 62 of each of the selected eight rib seats 52 is received in a respective one of the plurality of first upper positioning grooves 44*a* and 44*d*, and the second portion 64 of each of the selected eight rib seats 52 is received in the coupling groove 42. Thus, the first portions 62 and the second engaging portions 66 permit the selected eight rib seats 52 to be detachably assembled on the first coupling member 34 along the longitudinal axis of the post 20. The first portion 62 and the second engaging portion 66 of each of the selected eight rib seats 52 are received in the coupling groove 42, such that the selected eight rib seats 52 are spaced from each other in a circumferential direction about the longitudinal axis of the post 20 (see FIG. 5), avoiding disengagement of the selected eight rib seats 52 in a radial direction perpendicular to the longitudinal axis of the post 20 (see FIG. 9).

The fixed hub device 30 further includes a first upper fixing member 72 fixed on the first end face 36 and a second upper fixing member 74 fixed on the second end face 38. A top end of the base 54 of each of the selected eight rib seats 52 is secured by the first upper fixing member 72. A bottom end of the base 54 of each of the selected eight rib seats 52 is secured by the second upper fixing member 74. Furthermore, the selected eight rib seats 52 are coupled between the first and second upper fixing members 72 and 74. Thus, the selected eight rib seats 52 are securely coupled with the first coupling member 34 without the risk of disengagement.

The top end 22 of the post 20 is coupled in the coupling hole 50 of the second coupling member 48 of the fixed hub device 30. Two screws extend through the first and second coupling members 34 and 48 and abut against an outer periphery of the post 20 (FIG. 9) to thereby fix the fixed hub device 30 on the top end 22 of the post 20. The roller 24 is located below the fixed hub device 30 along the longitudinal axis of the post 20.

The umbrella 10 further includes a runner device 76 slideably mounted to the post 20 and slideable along the longitudinal axis of the post 20. The runner device 76 includes a lower coupling sleeve 78 having a top end face 80, a bottom end face 82 spaced from the top end face 80 along the longitudinal axis of the post 20, and a peripheral face 84 between the top end face 80 and the bottom end face 82. The lower coupling sleeve 78 further includes a lower receiving hole 86 extending from the top end face 80 through the bottom end face 82 and spaced from the peripheral wall 84. The lower coupling sleeve 78 further includes a plurality of first lower positioning grooves 90 defined in the top end face 80 and spaced from each other in the circumferential direction of the longitudinal axis of the post 20. Each of the plurality of first lower positioning grooves 90 extends to the peripheral face 84. The number of the plurality of first lower positioning grooves 90 is equal to the number of the plurality of first upper positioning grooves 44*a*-44*d*. The plurality of first lower positioning grooves 90 is respectively aligned with the plurality of first upper positioning grooves 44*a*-44*d*.

The lower coupling sleeve 78 further includes four first lower fixing grooves 91 defined in the top end face 80, spaced from the plurality of first lower positioning grooves 90 in the circumferential direction of the longitudinal axis of the post 20, and respectively aligned with the four first upper fixing grooves 45. Furthermore, the lower coupling sleeve 78 includes four second lower fixing grooves 93 defined in the bottom end face 82 and respectively aligned with the four first lower fixing grooves 91.

The lower coupling sleeve 78 further includes an insertion groove 88 defined in the top end face 80 and intercommunicating with the plurality of first lower positioning groove 90 and the four first lower fixing grooves 91. In an example, the insertion groove 88 extends from the top end face 80 towards but spaced from the bottom end face 82. The lower coupling groove 78 further includes a plurality of second lower positioning groves 92 defined in the bottom end face 82 and respectively aligned with the plurality of first lower positioning grooves 90. The number of the plurality of second lower positioning groves 92 is equal to the number of the plurality of first lower positioning grooves 90.

The runner device 76 further includes a plurality of stretcher seats 98 detachably coupled with the lower coupling sleeve 78. Each of the plurality of stretcher seats 98 includes a body 111 having an inner side 113 and an outer side 115. Each of the plurality of stretcher seats 98 further includes two lower lugs 135 disposed on the outer side 115 and first and second positioning portions 117 and 133 disposed on the inner side 113. The first positioning portion 117 includes a narrower portion 119 and a wider portion 131 having a volume larger than a volume of the narrower portion 119. The wider portion 131 is spaced from the inner side 113 of the body 111.

Some or all of the plurality of stretcher seats 98 are selected to engage with the lower coupling sleeve 78. The number of the selected stretcher seats 98 is equal to the number of the selected rib seats 52. In the example shown in FIGS. 4, 7, and 8, eight stretcher seats 98 are selected to engage with the lower coupling sleeve 78. The selected eight stretcher seats 98 are respectively aligned with eight of the plurality of first lower positioning grooves 90 spaced from each other by 45°. The first positioning portion 117 of each of the selected eight stretcher seats 98 engages with a respective one of the plurality of first lower positioning grooves 90, and the second positioning portion 133 of each of the selected eight stretcher seats 98 engage with a respective one of the plurality of second lower positioning grooves 92. Furthermore, the narrower portion 119 of each of the selected eight stretcher seats 98 is received in a respective one of the plurality of first lower positioning grooves 90, and the wider portion 131 of each of the selected eight stretcher seats 98 is received in the insertion groove 88. Thus, the narrower portions 119 and the wider portions 131 permit the selected eight stretcher seats 98 to be detachably assembled on the lower coupling sleeve 78 along the longitudinal axis of the post 20. The wider portion 131 of each of the selected eight stretcher seat 98 is received in the insertion groove 88, such that the selected eight stretcher seat 98 are spaced from each other in the circumferential direction about the longitudinal axis of the post 20.

The runner device 76 further includes a first lower fixing member 139 fixed on the top end face 80 of the lower coupling sleeve 78 and a second lower fixing member 153 fixed on the bottom end face 82 of the lower coupling sleeve 78. The first lower fixing member 139 includes a cable fixing portion 151 disposed on an upper face thereof. A top end of the body 111 of each of the selected eight stretcher seats 98 is secured by the first lower fixing member 139. A bottom end of the body 111 of each of the selected eight stretchers seats 98 is secured by the second lower fixing member 153. Thus, the selected eight stretchers seats 98 is secured to the lower coupling sleeve 78.

Figure 4:
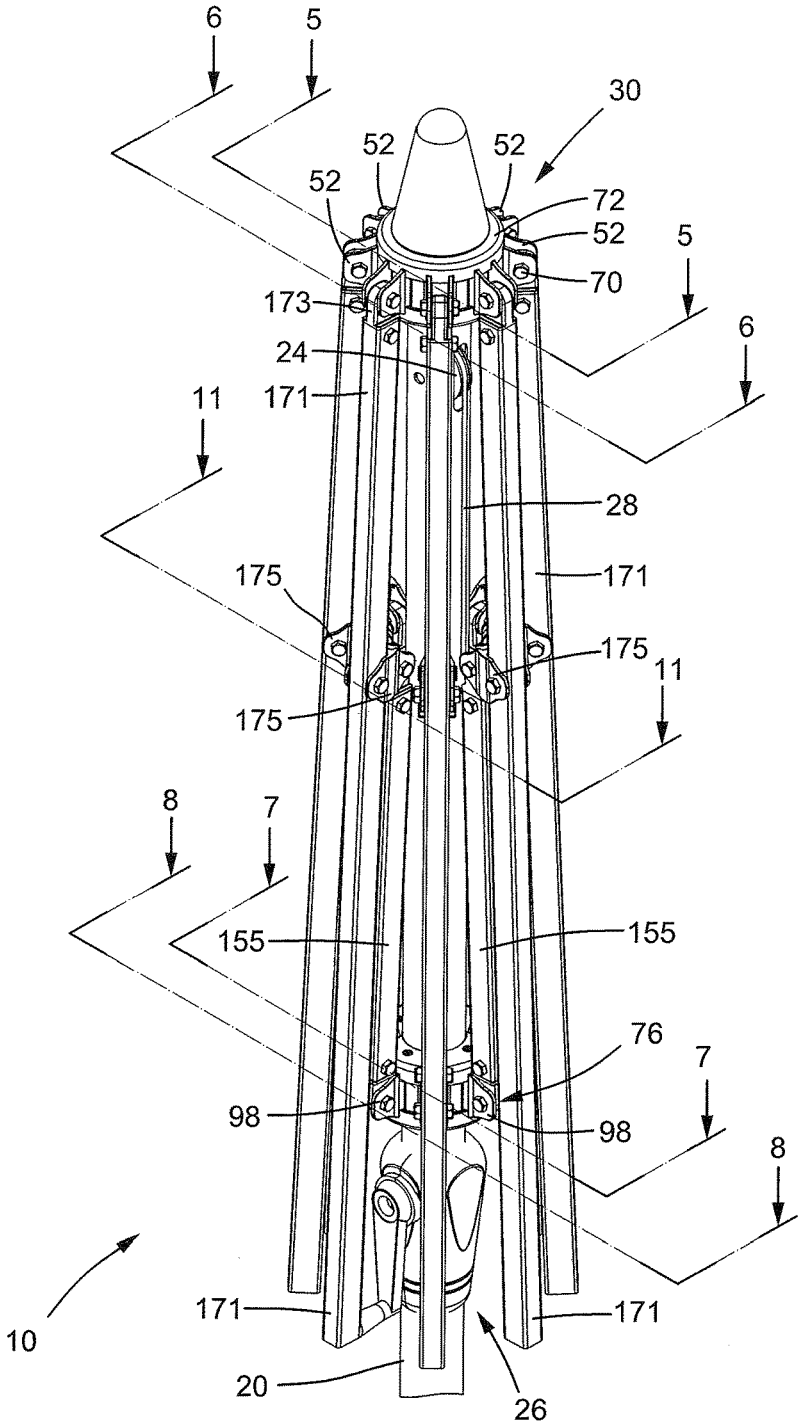
FIG. 4 is a perspective view of a modular umbrella of an example according to the present invention, with the modular umbrella including eight ribs and being in a folded state.

The runner device 76 further includes a sliding sleeve 94 having a sliding hole 96 with an inner diameter slightly larger than the outer diameter of the post 20. The sliding sleeve 94 is fixed in the lower receiving hole 86 of the lower coupling sleeve 78. The sliding hole 96 slideably receives the post 20. As shown in FIG. 4, the runner device 76 is located between the cable winding device 26 and the fixed hub device 30 along the longitudinal axis of the post 20.

Figure 3:
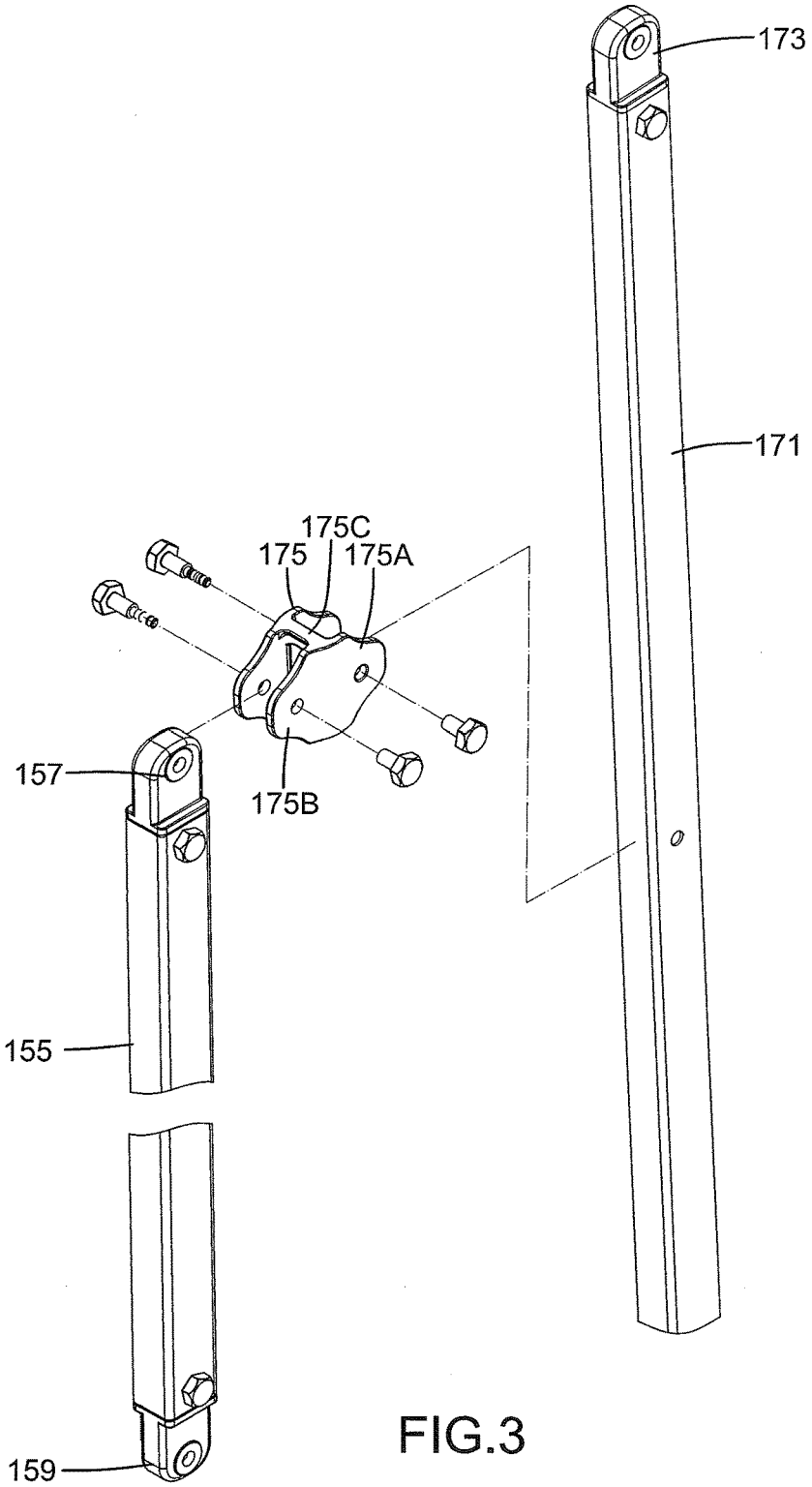
FIG. 3 is an exploded, perspective view of a rib, a stretcher, and a connecting member of the modular umbrella of FIG. 1.

The umbrella 10 further includes a plurality of ribs 171 and a plurality of stretchers 155 pivotably connected to the plurality of ribs 171. Each of the plurality of ribs 171 includes a pivotal end 173. With reference to FIG. 3, the pivotal end of each of the plurality of ribs 171 can be a plastic member formed on a distal end of a metal hollow tube by injection molding and having a hole.

Each of the plurality of stretchers 155 includes a first pivotal end 157 and a second pivotal end 159. Referring to FIG. 3, the first pivotal end 157 and the second pivotal end 159 can be plastic members respectively formed on two ends of a metal hollow tube by injection molding, with each of the plastic members having a hole.

The umbrella 10 further includes a plurality of connecting members 175. Each of the plurality of connecting members 175 connects one of the plurality of ribs 171 to one of the plurality of stretchers 155. Each of the plurality of connecting members 175 includes a substantially U-shaped first engaging portion 175A, a substantially U-shaped second engaging portion 175B, and an intermediate portion 175C between the first engaging portion 175A and the second engaging portion 175B. The first engaging portion 175A of each of the plurality of connecting members 175 is coupled to an intermediate section of a respective one of the plurality of ribs 171. The second engaging portion 175B of each of the plurality of connecting members 175 is pivotably connected to the first pivotal end 157 of a respective one of the plurality of stretchers 155. Furthermore, a plurality of first engaging screws 175D and a plurality of second engaging screws 175E are provided. With reference to FIG. 3, in an example, two first engaging screws 175D extend through the first engaging portion 175A of a respective one of the plurality of connecting members 175 and a respective one of the plurality of ribs 171, and two second engaging screws 175E extend through the second engaging portion 175B of a respective one of the plurality of connecting members 175 and the first pivotal end 157 of a respective one of the plurality of stretchers ribs 155. Thus, pivotal connection between each of the plurality of stretchers 155 and a respective one of the plurality of ribs 171 is permitted.

In an alternative example, each of the plurality of first engaging screws 175D is detachably coupled to the first engaging portion 175A of a respective one of the plurality of connecting members 175 and fixes a respective one of the plurality of ribs 171 to the first engaging portion 175A, and each of the plurality of second engaging screws 175E is detachably coupled to the second engaging portion 175B of a respective one of the plurality of connecting members 175 and pivotably connects the first pivotal end 157 of a respective one of the plurality of stretchers 155 to the second engaging portion 175B.

Figure 12:
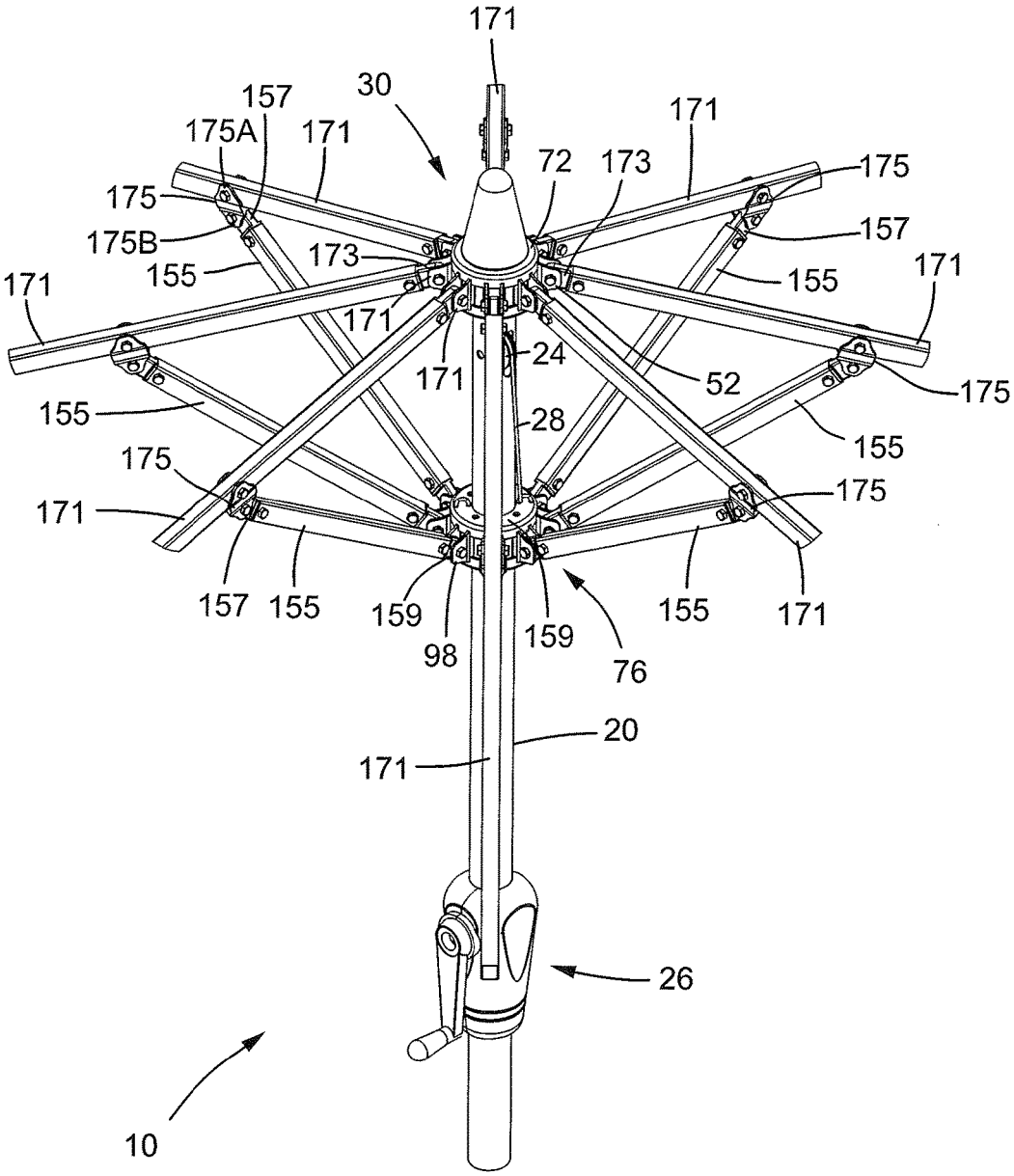
FIG. 12 is a perspective view of the modular umbrella of FIG. 4 in an unfolded state.

In an example, eight ribs 171 are selected to pivotably connect with eight selected rib seats 52 by the pivotal ends 173. Each of the selected eight ribs 171 is connected to one of the selected eight ribs 52 by an upper pivot 170 consisting of a screw and another screw with an internal thread and extending through associated upper lugs 68 and an associated pivotal end 173 (FIG. 6), permitting relative pivotal movement between each of the selected eight ribs 171 and one of the selected eight rib seats 52 (see FIGS. 4 and 12).

The second pivotal end 159 of each of the selected eight stretchers 155 is pivotably connected to one of the selected eight stretcher seats 98. In an example, each of the selected eight ribs 171 is connected to one of the selected eight ribs 52 by a lower pivot 137 consisting of a screw and another screw with an internal thread and extending through associated lower lugs 135 and an associated pivotal end 173 (FIG. 8), permitting relative pivotal movement of each of the selected eight stretchers 155 relative to one of the selected eight stretcher seats 98 and one of the selected eight ribs 171 (see FIGS. 4 and 13).

Figure 5:
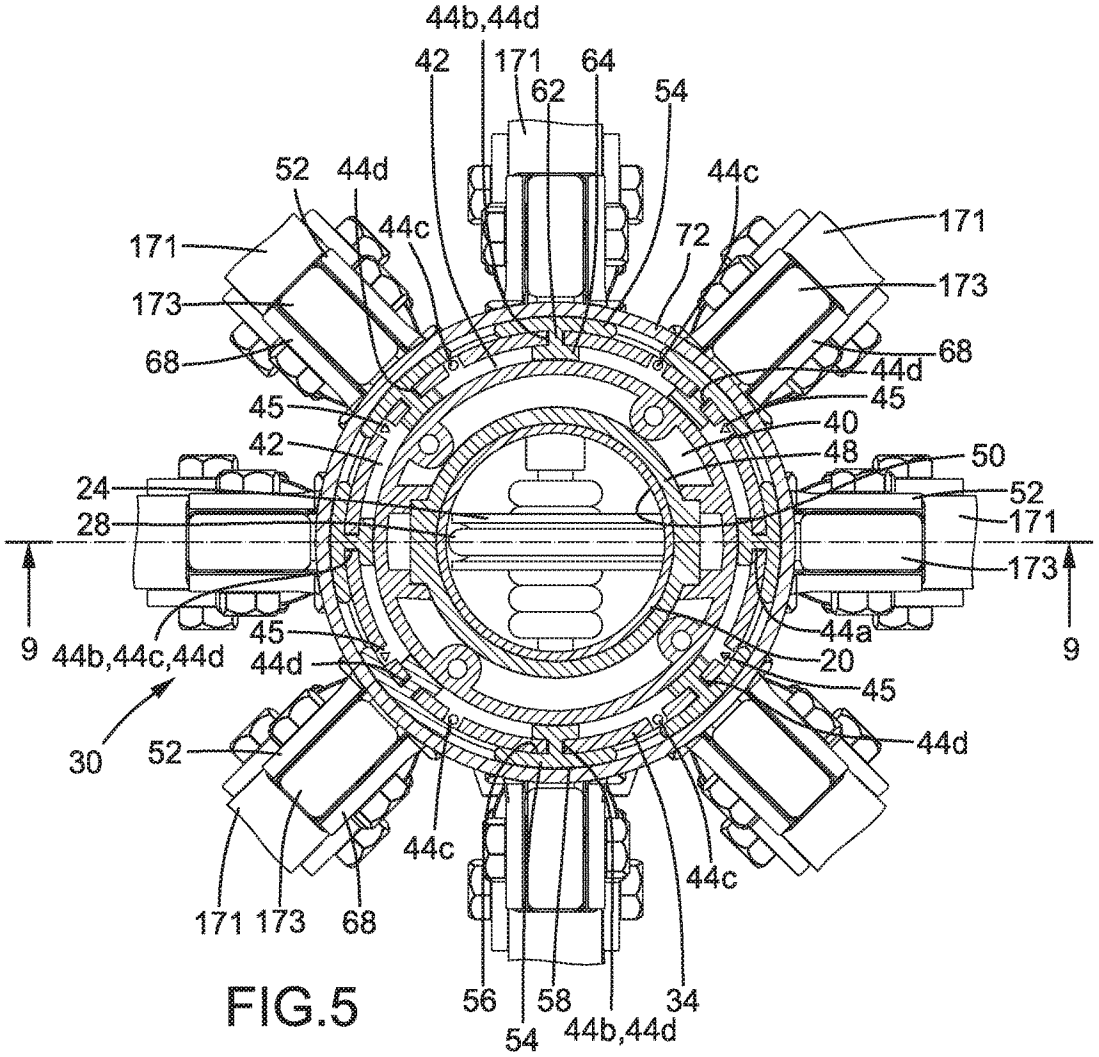
FIG. 5 is a cross sectional view taken along section line 5-5 of FIG. 4.
Figure 6:
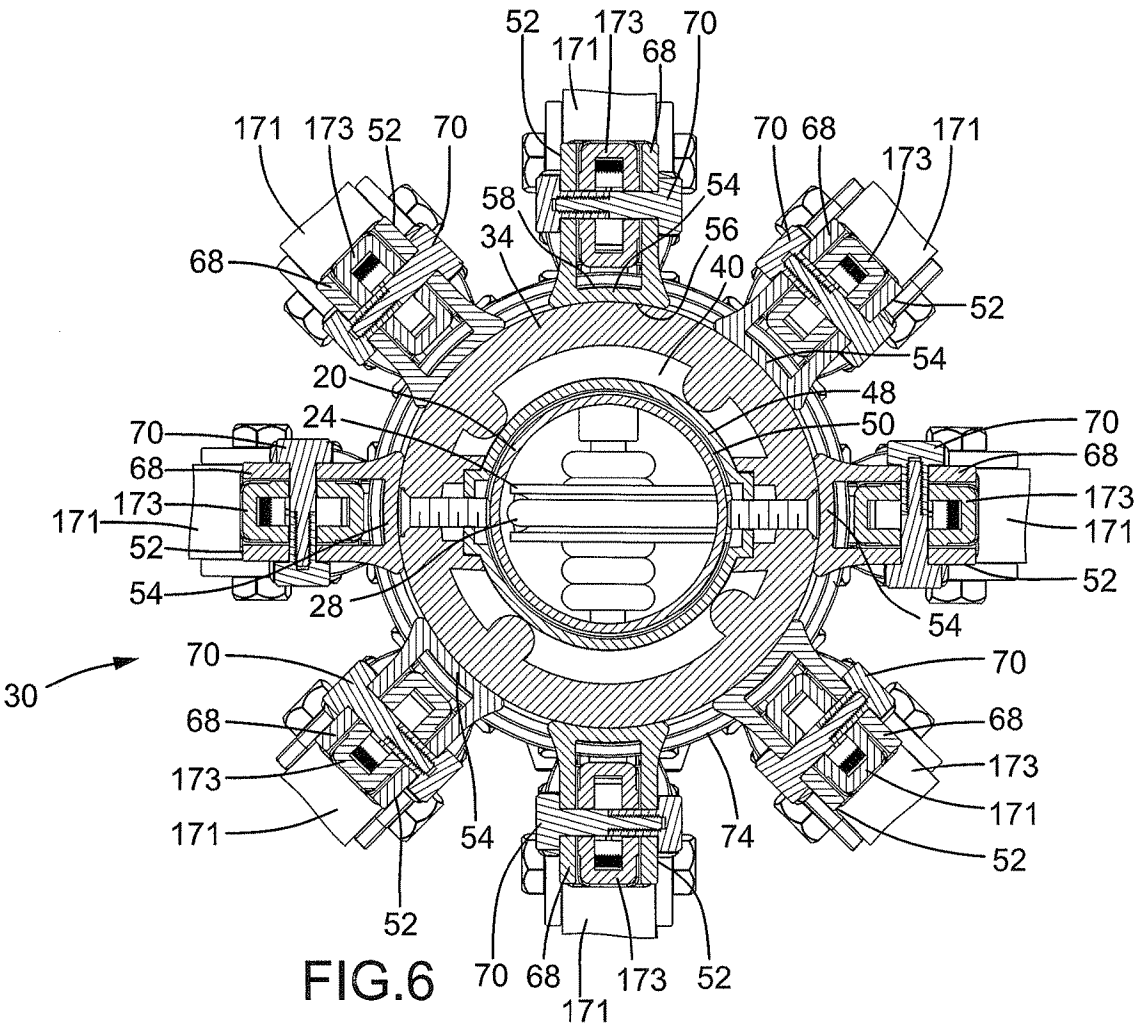
FIG. 6 is a cross sectional view taken along section line 6-6 of FIG. 4.
Figure 7:
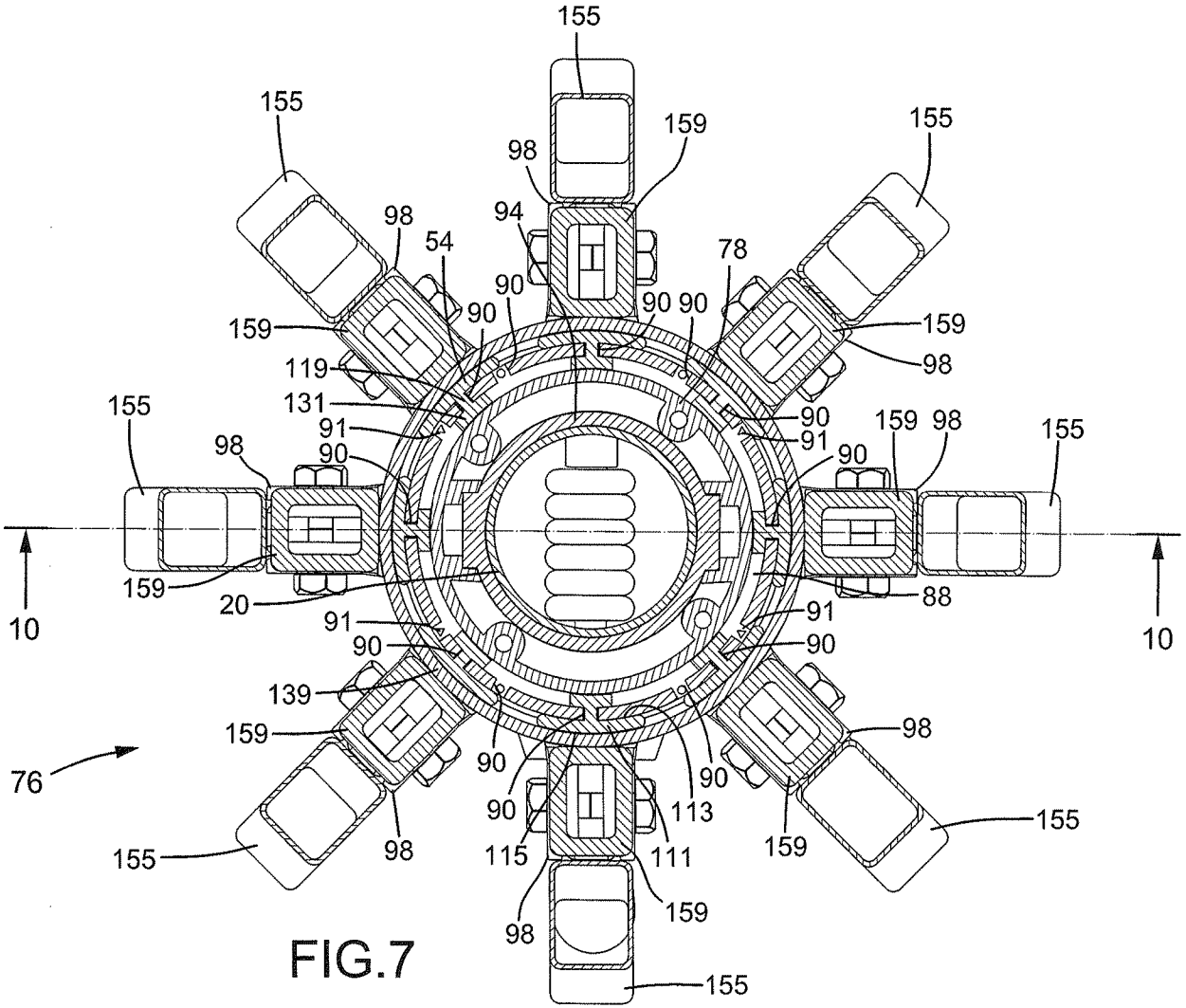
FIG. 7 is a cross sectional view taken along section line 7-7 of FIG. 4.
Figure 8:
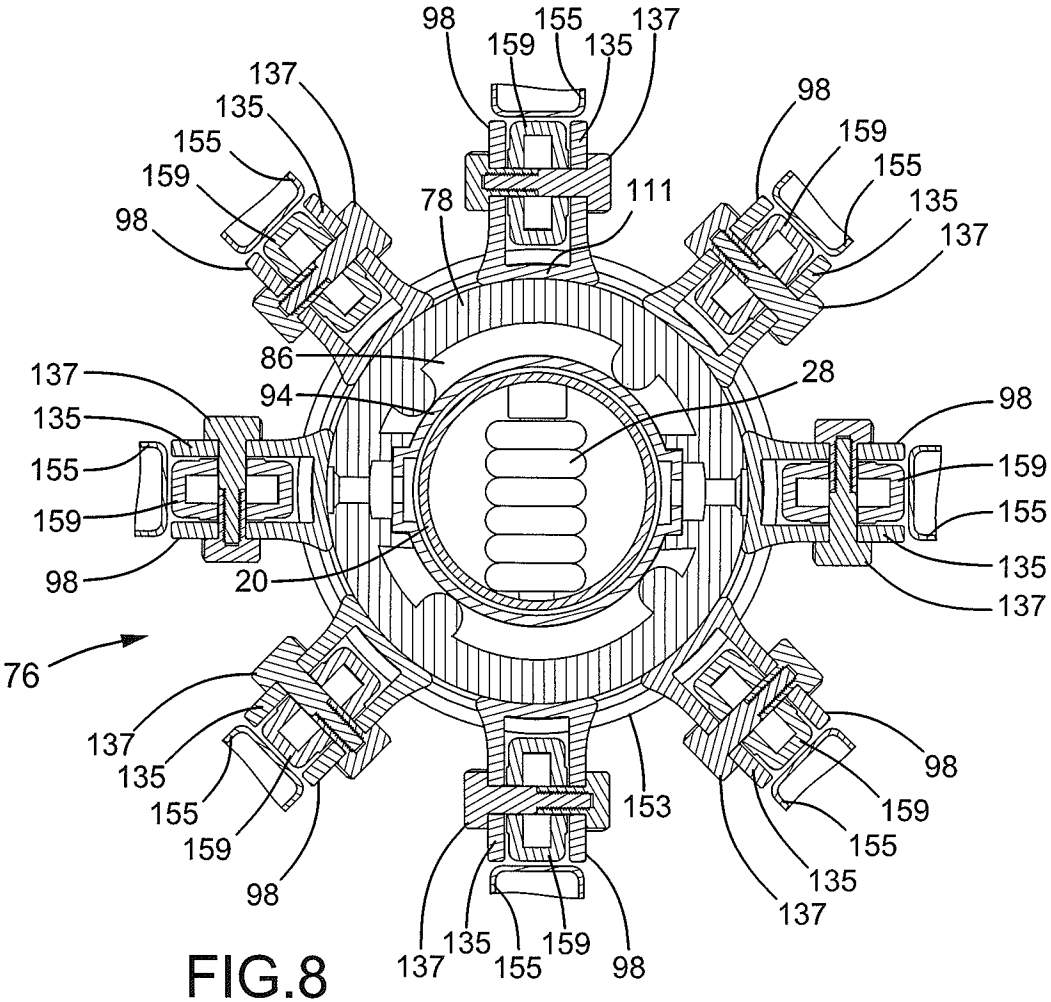
FIG. 8 is a cross sectional view taken along section line 8-8 of FIG. 4.
Figure 9:
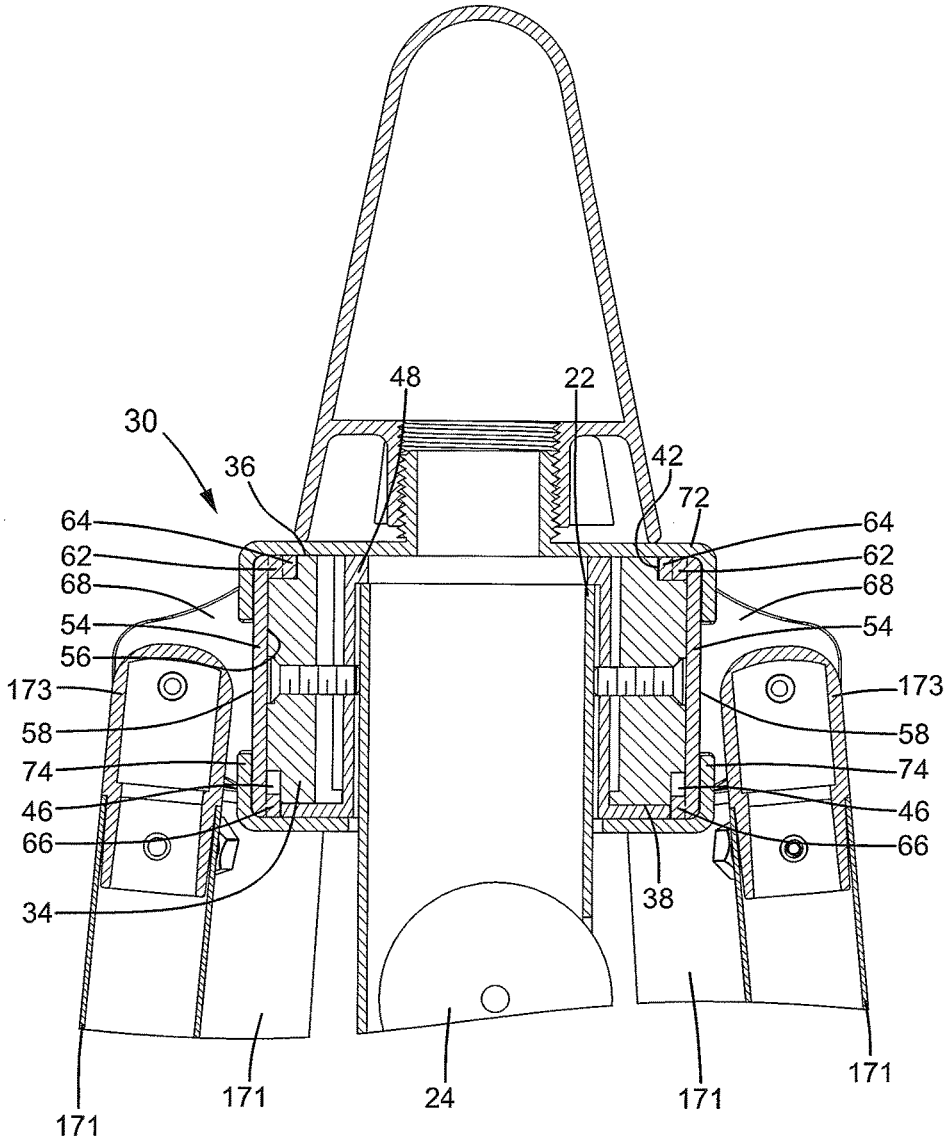
FIG. 9 is a cross sectional view taken along section line 9-9 of FIG. 5.
Figure 10:
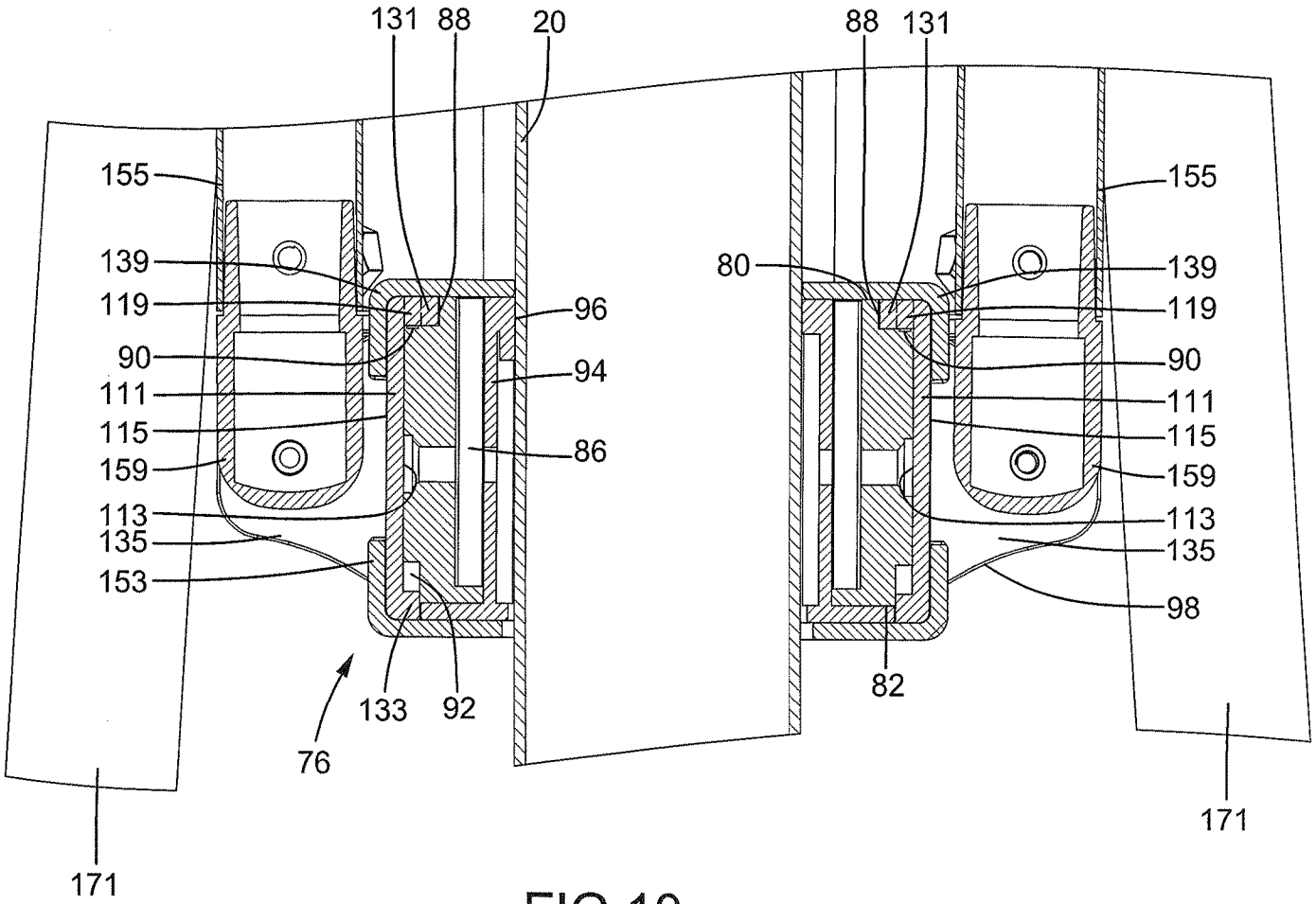
FIG. 10 is a cross sectional view taken along section line 10-10 of FIG. 7.
Figure 11:
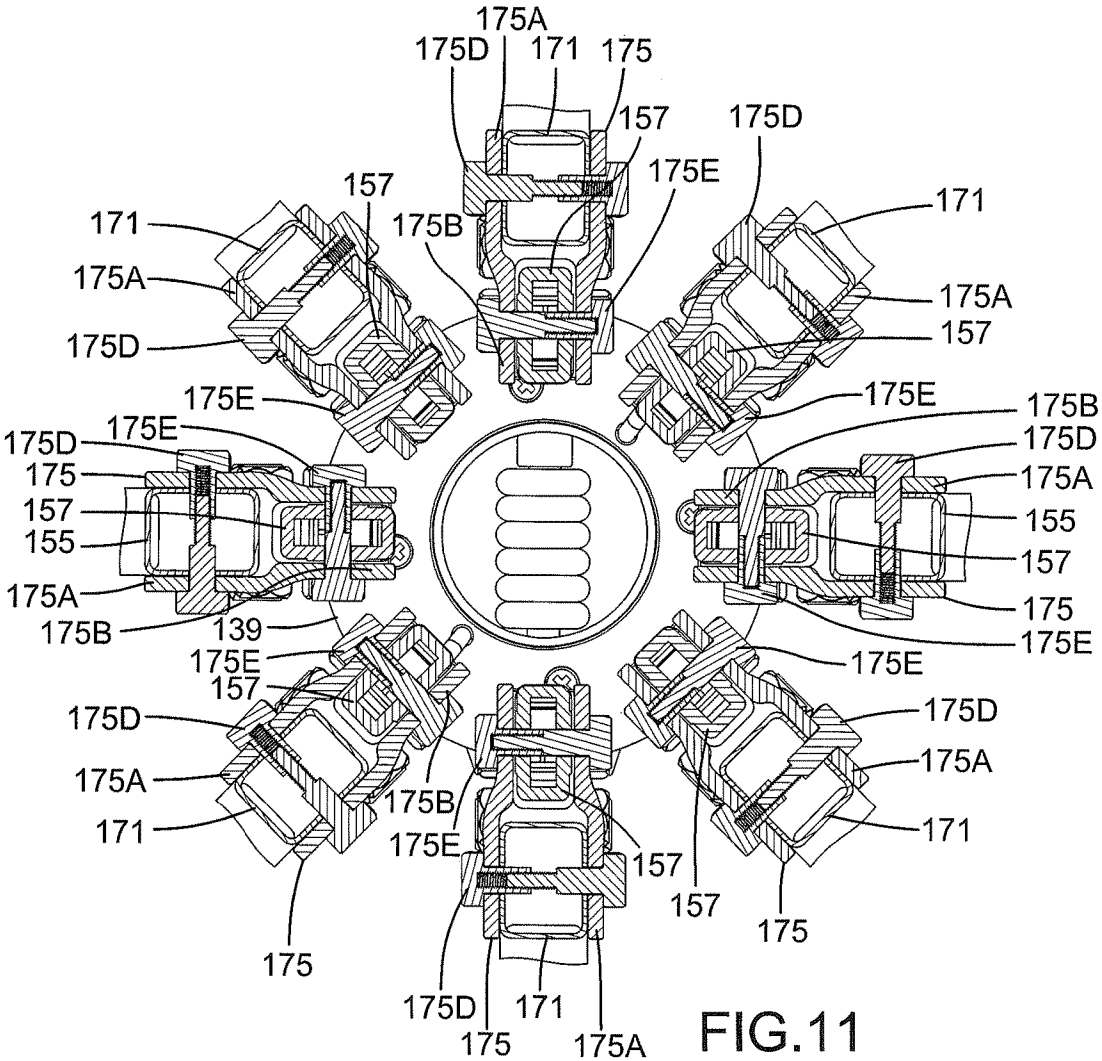
FIG. 11 is a cross sectional view taken along section line 11-11 of FIG. 4.

With reference to FIGS. 4, 5, and 7, the umbrella 10 can be assembled to include eight ribs 171, eight rib seats 52, and eight stretchers 155. The second end of the cable 28 is fixed to the cable fixing portion 151 of the first lower fixing member 139. When the cable winding device 26 is operate to wind or release the cable 28, the runner device 76 is actuated to move along the longitudinal axis of the post 20. FIG. 4 shows that runner device 76 is in a lower position adjacent to the cable winding device 26, and the selected eight ribs 171 are in a collapsed state adjacent to the post 20 (FIGS. 4, 9, and 10).

When the cable 28 is wound through operation of the cable winding device 26, the cable 28 pulls the runner device 76 upward to an upper position adjacent to the fixed hub device 30, and the selected eight stretchers 155 pivot the selected eight ribs 171 away from the post 20 to gradually stretch the selected eight ribs 171 outward. When the runner device 76 reaches the upper position (FIG. 12), the selected eight ribs 171 is in an unfolded state to stretch open the canopy mounted on the selected eight ribs 171.

Figure 13:
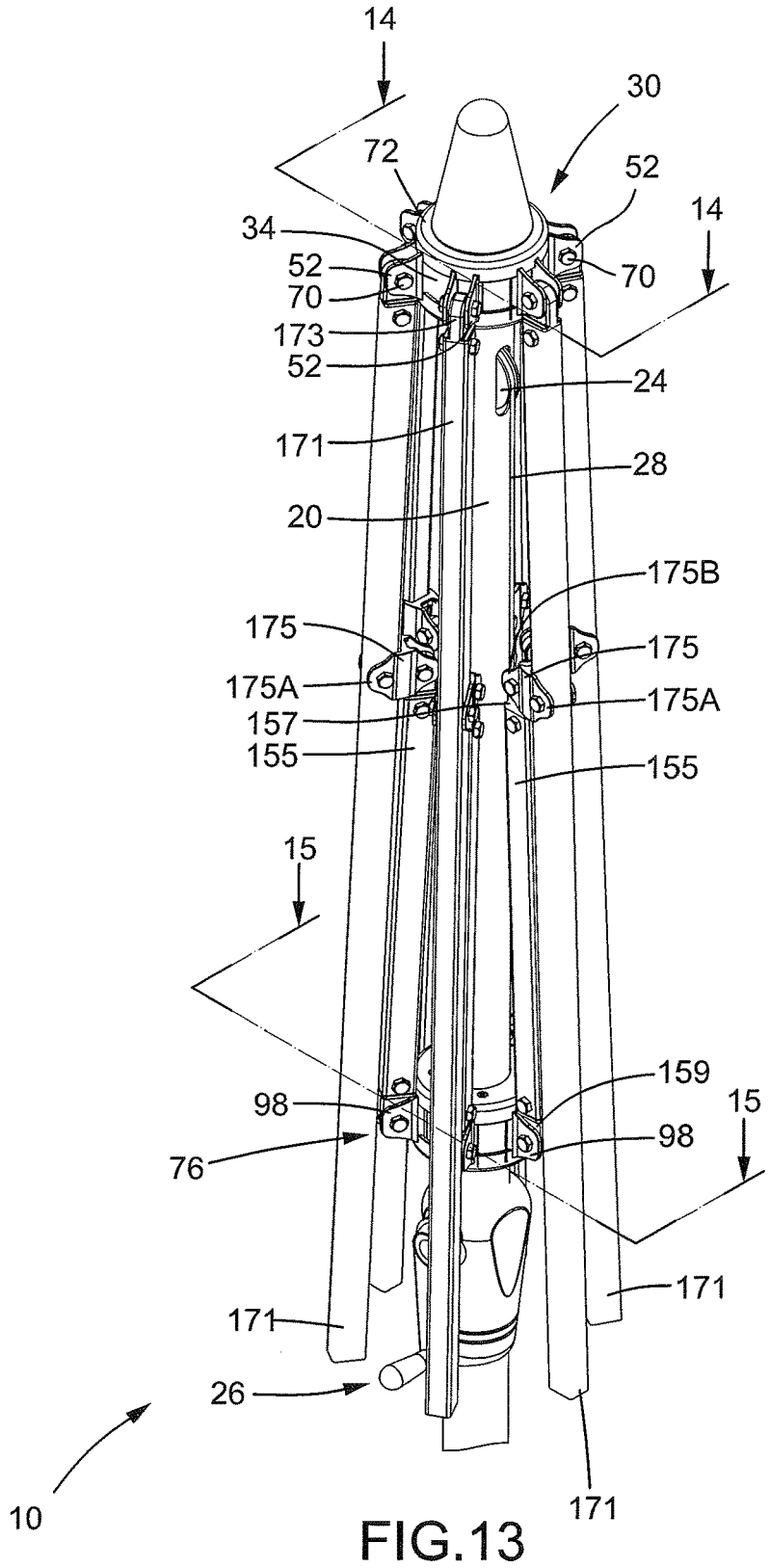
FIG. 13 is a perspective view of a modular umbrella of another example according to the present invention, with the modular umbrella including six ribs and being in a folded state.
Figure 14:
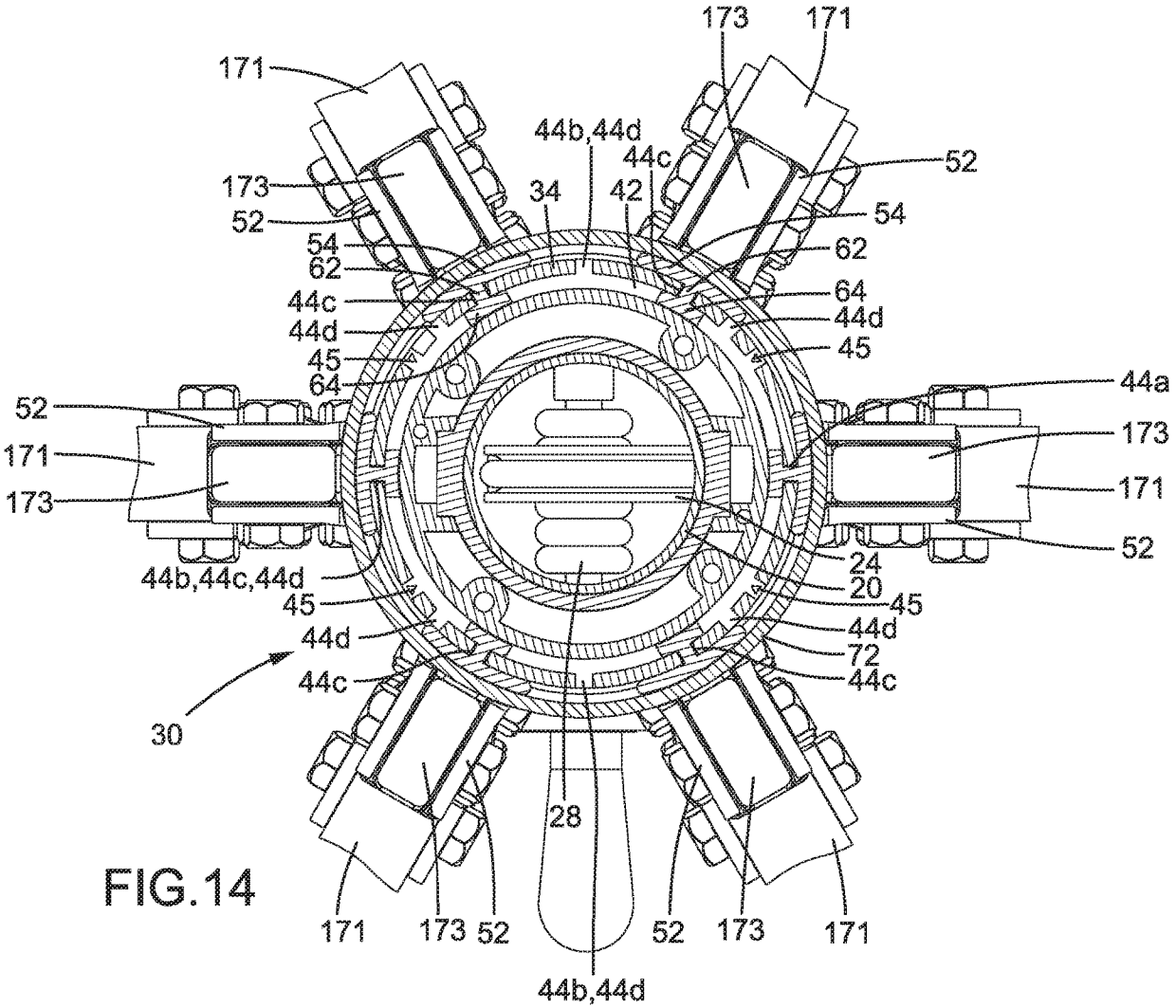
FIG. 14 is a cross sectional view taken along section line 14-14 of FIG. 13.
Figure 15:
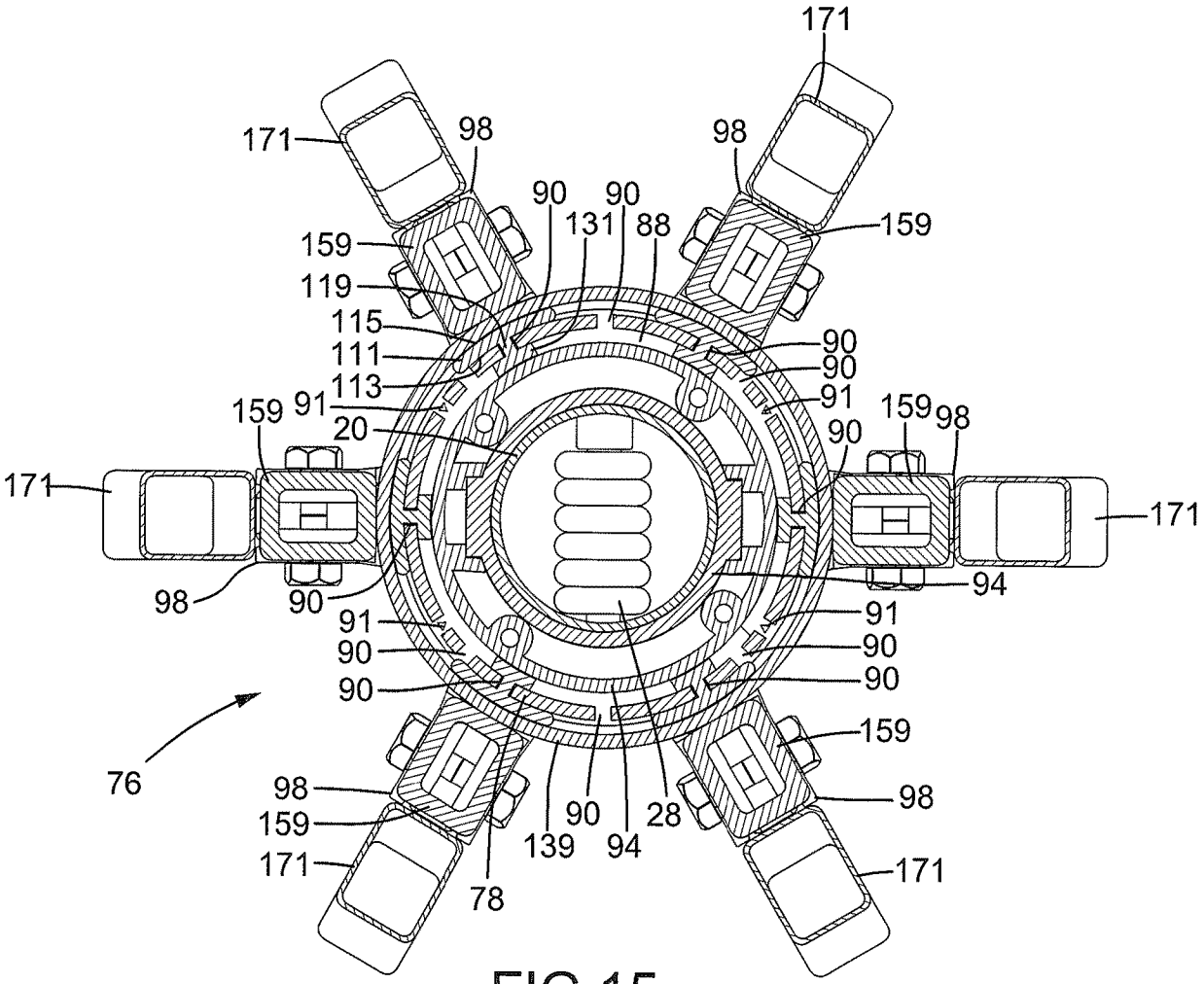
FIG. 15 is a cross sectional view taken along section line 15-15 of FIG. 13.

With reference to FIGS. 13-15, the umbrella 10 can be assembled to include six ribs 171, six rib seats 52, and six stretchers 155. The selected six rib seats 52 detachably engage with the first groove 44*a* and the plurality of third grooves 44*c* spaced from each other by 60° and detachably engage with six of the plurality of second upper positioning grooves 46 aligned with the first groove 44*a* and the plurality of third grooves 44*c*. The selected six stretcher seats 98 detachably engage with six of the plurality of first lower positioning grooves 90 spaced from each other by 60° and detachably engage with six of the plurality of second lower positioning grooves 92 spaced from each other by 60°. The second pivotal end 159 of each of the selected six stretchers 155 is pivotably connected to a respective one of the selected six stretcher seats 98.

Figure 16:
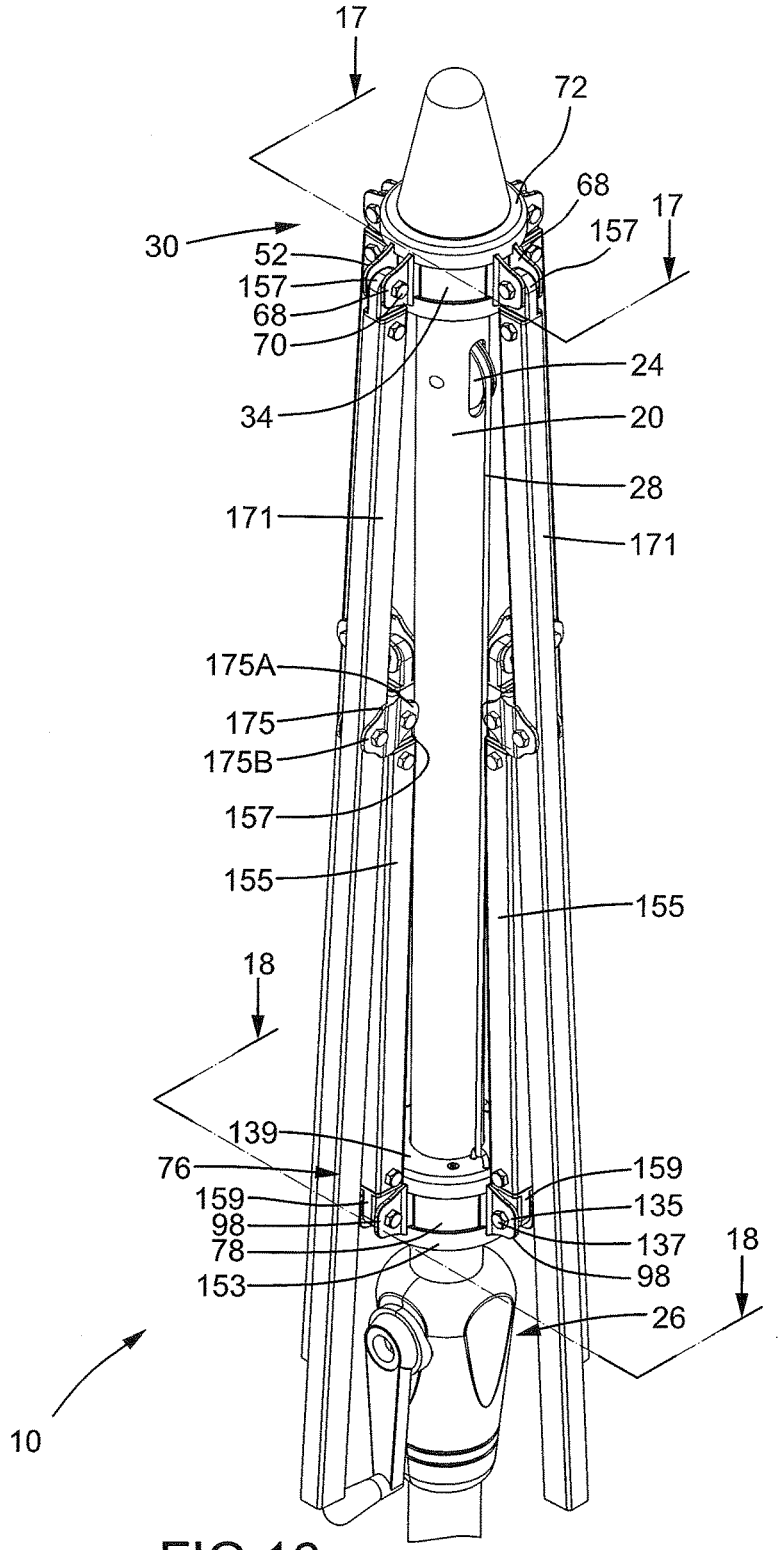
FIG. 16 is a perspective view of a modular umbrella of a further example according to the present invention, with the modular umbrella including four ribs for a square canopy and being in a folded state.
Figure 17:
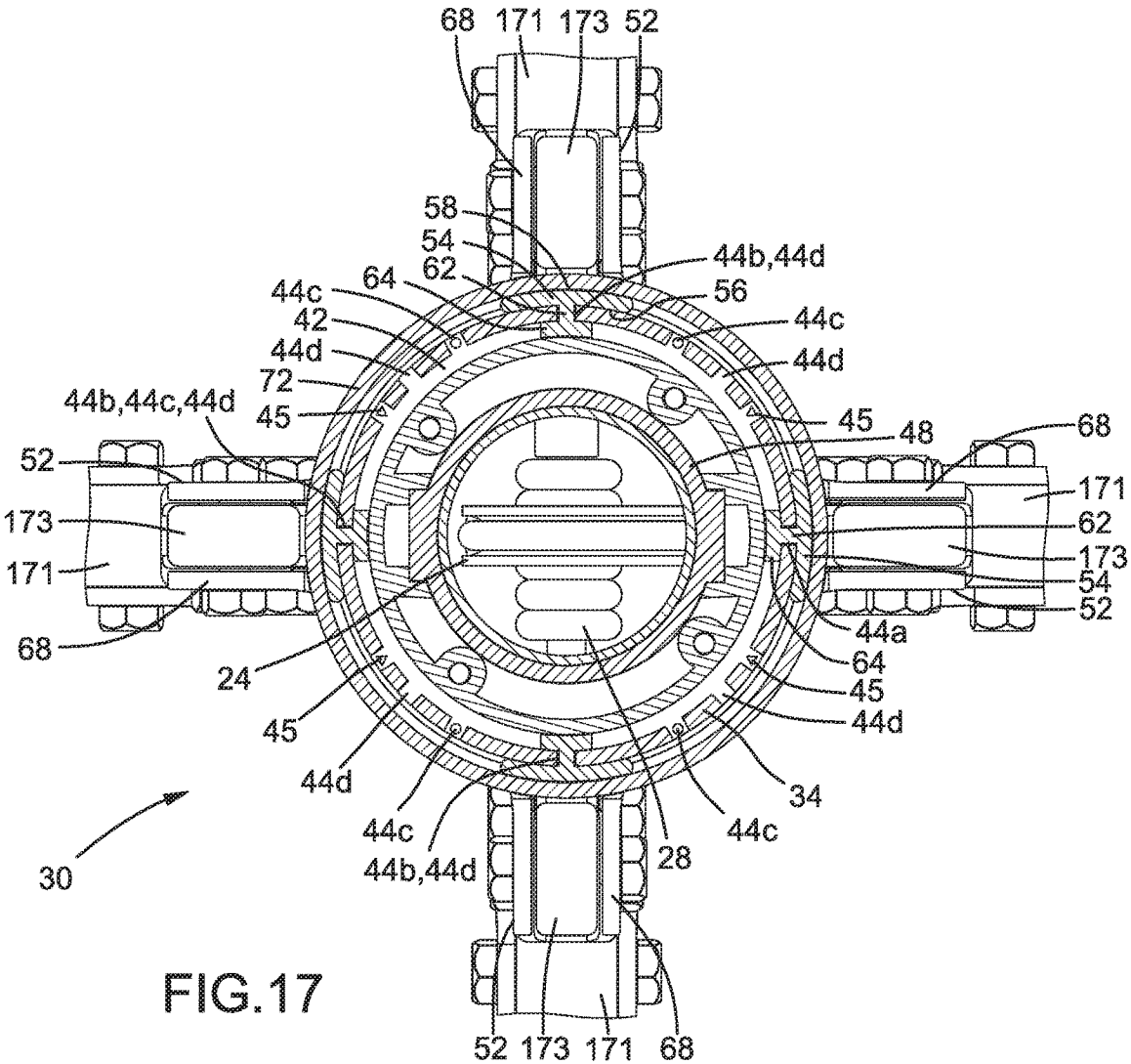
FIG. 17 is a cross sectional view taken along section line 17-17 of FIG. 16.
Figure 18:
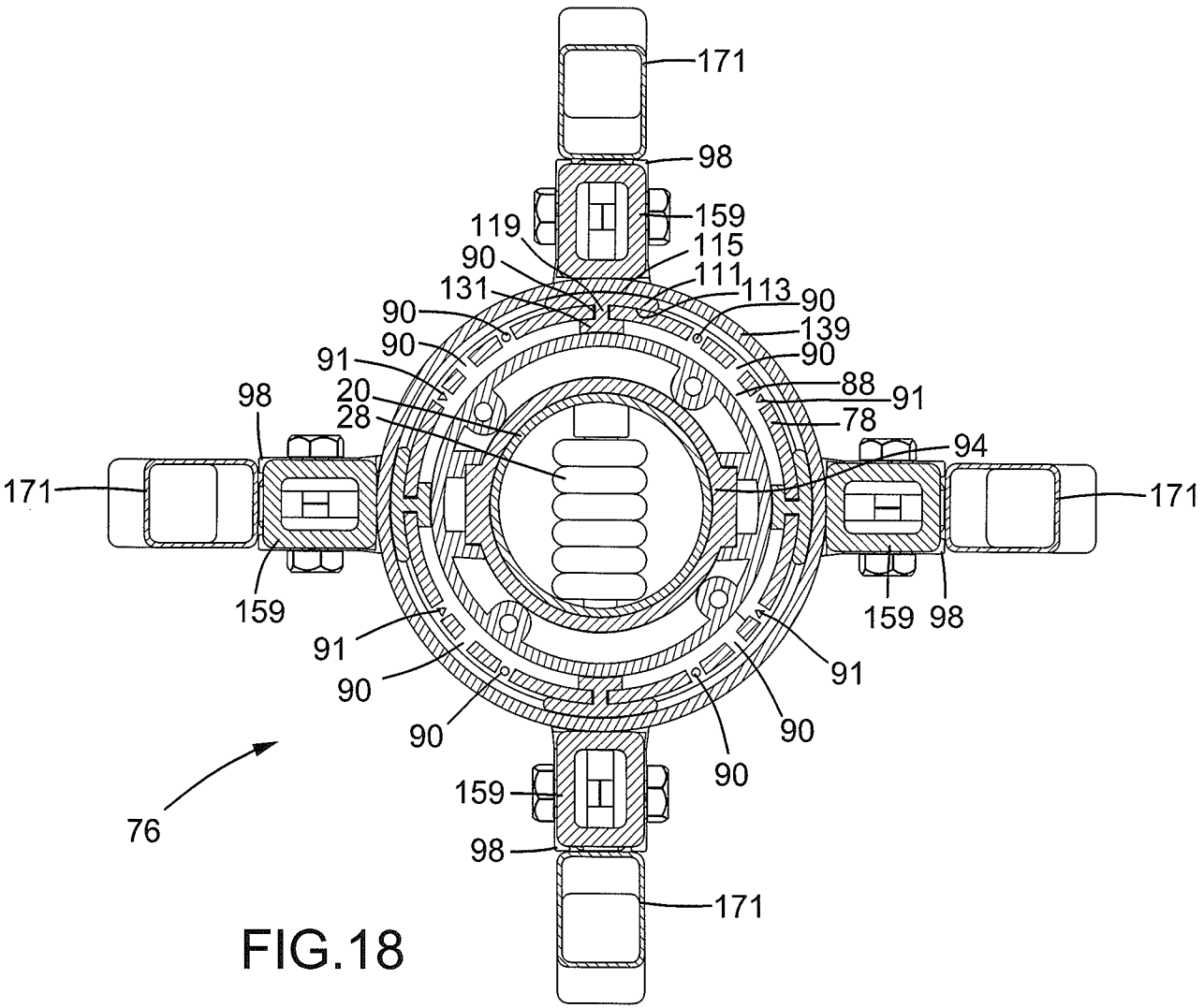
FIG. 18 is a cross sectional view taken along section line 18-18 of FIG. 16.

With reference to FIGS. 16-18, the umbrella 10 can be assembled to include four rib seats 52, four stretchers 155, and four ribs 171 supporting a square canopy. The selected four rib seats 52 detachably engage with the first groove 44*a* and the plurality of second grooves 44*b* spaced from each other by 90° and detachably engage with four of the plurality of second upper positioning grooves 46 aligned with the first groove 44*a* and the plurality of second grooves 44*b*. The selected four stretcher seats 98 detachably engage with four of the plurality of first lower positioning grooves 90 spaced from each other by 90° and detachably engage with six of the plurality of second lower positioning grooves 92 spaced from each other by 90°. The second pivotal end 159 of each of the selected four stretchers 155 is pivotably connected to a respective one of the selected four stretcher seats 98. Thus, the umbrella 10 includes four ribs 171 for supporting a square canopy.

Figure 19:
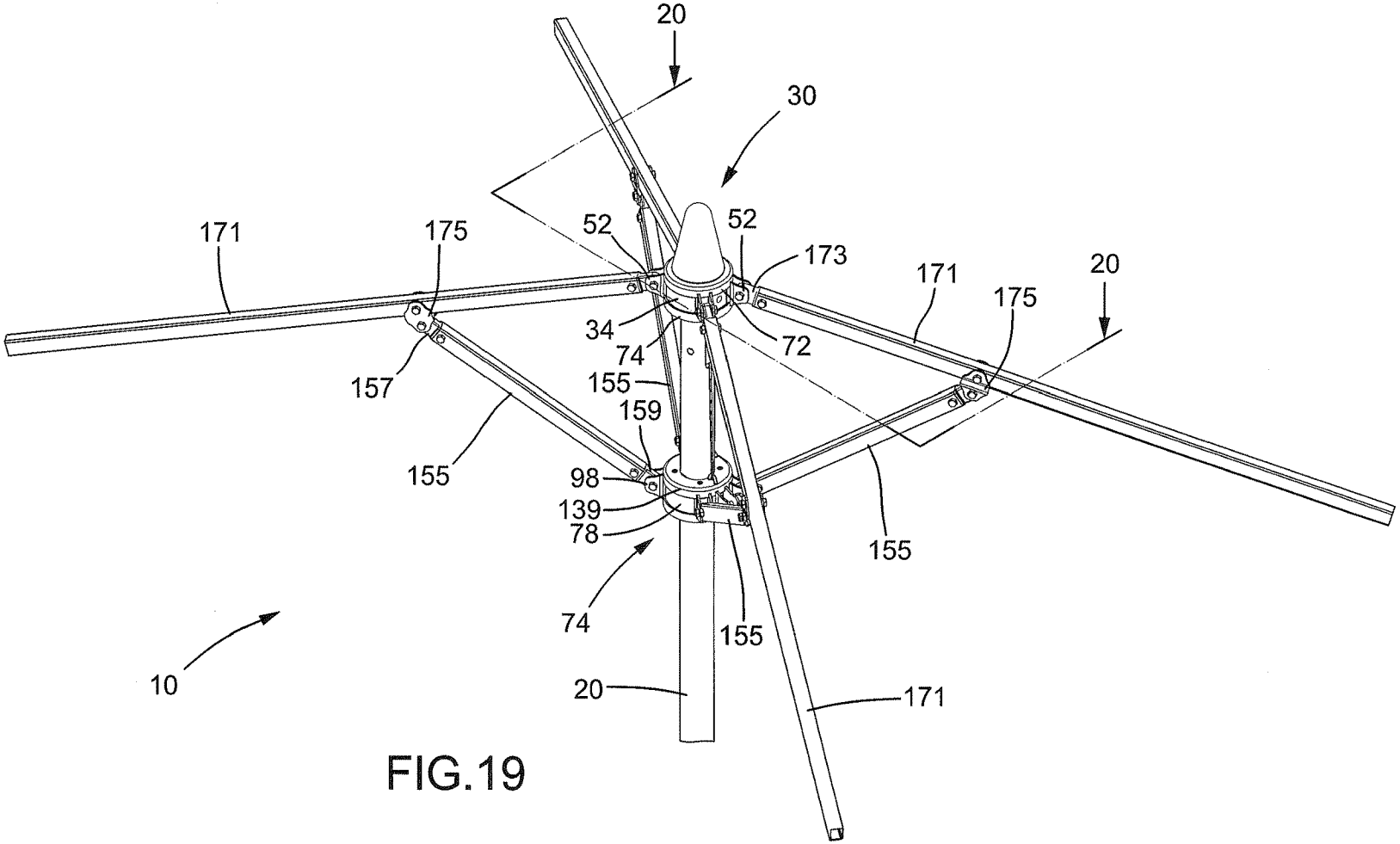
FIG. 19 is a perspective view of a modular umbrella of still another example according to the present invention, with the modular umbrella including four ribs for a rectangular canopy and being in a folded state.
Figure 20:
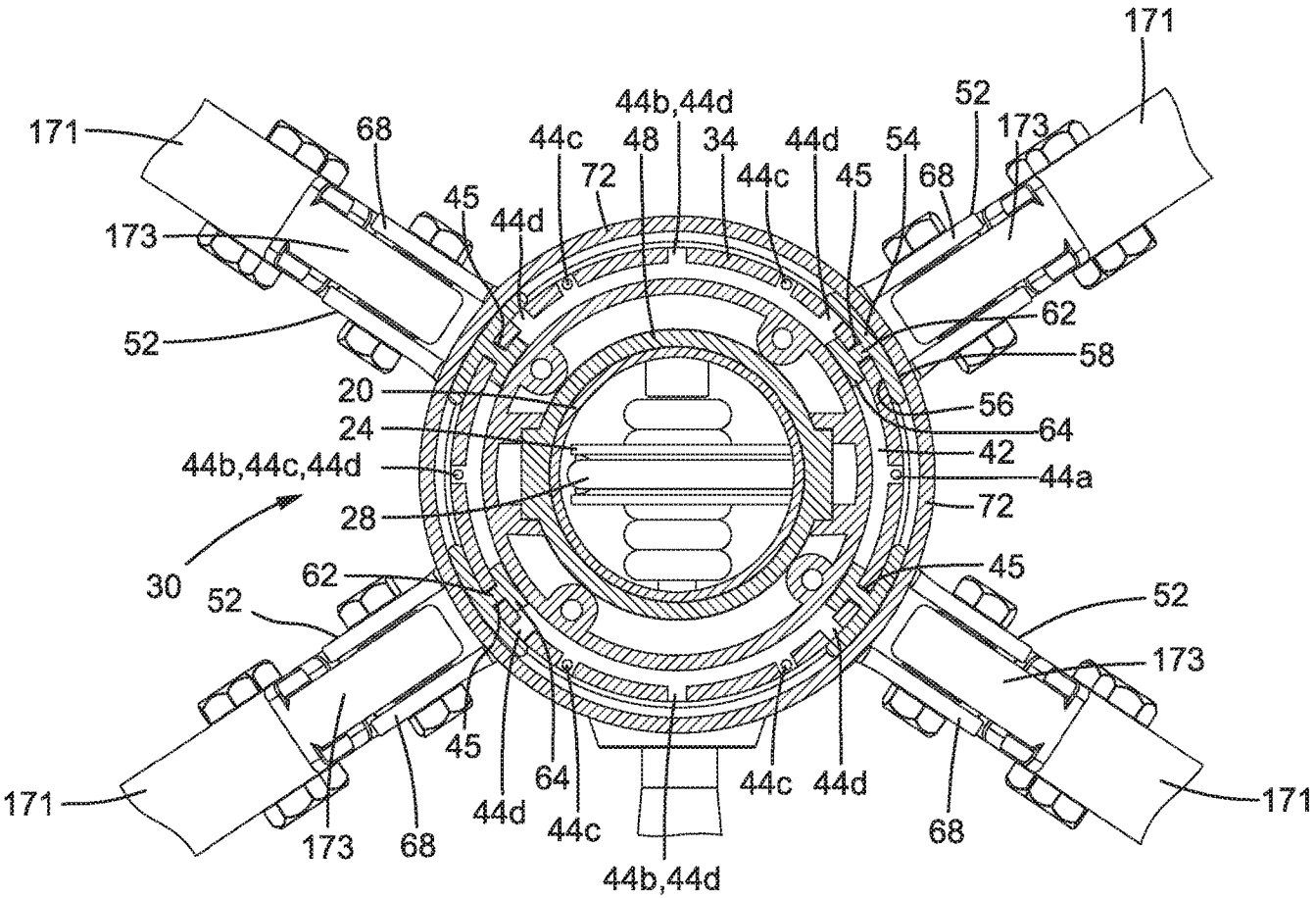
FIG. 20 is a cross sectional view taken along section line 20-20 of FIG. 19.

With reference to FIGS. 19 and 20, the umbrella 10 can be assembled to support a rectangular canopy. Specifically, the selected four stretcher seats 52 detachably engage with the four first upper fixing grooves 45 and the four second upper fixing grooves 47. The selected four stretcher seats 98 detachably engage with the four first lower fixing grooves 91 and the four second lower fixing grooves 93. The second pivotal end 159 of each of the selected four stretchers 155 is pivotably connected to a respective one of the selected four stretcher seats 98. Thus, the umbrella 10 includes four ribs 171 for supporting a rectangular canopy.

Figure 21:
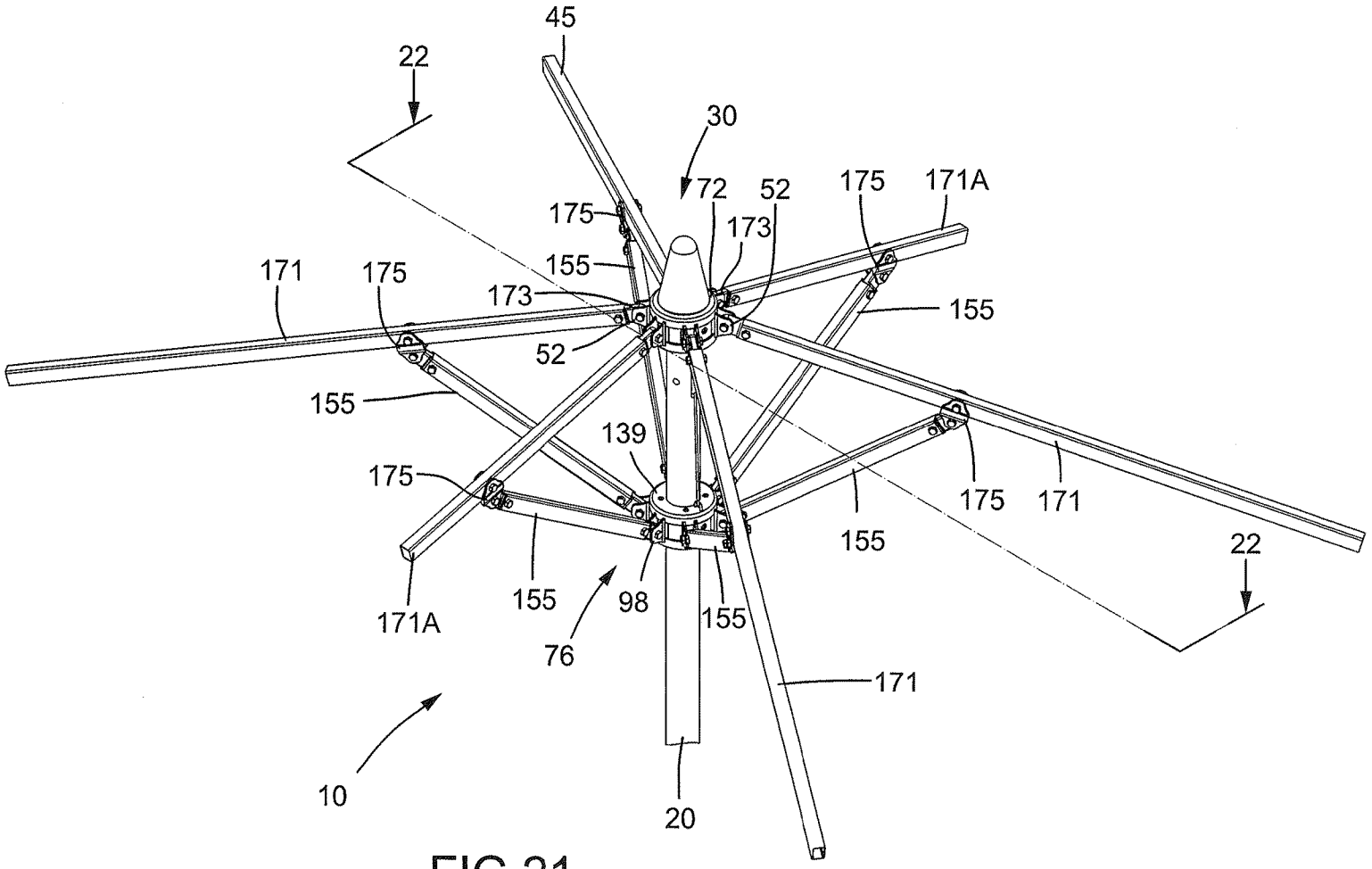
FIG. 21 is a perspective view of a modular umbrella of yet another example according to the present invention, with the modular umbrella including six ribs for a rectangular canopy and being in a folded state.
Figure 22:
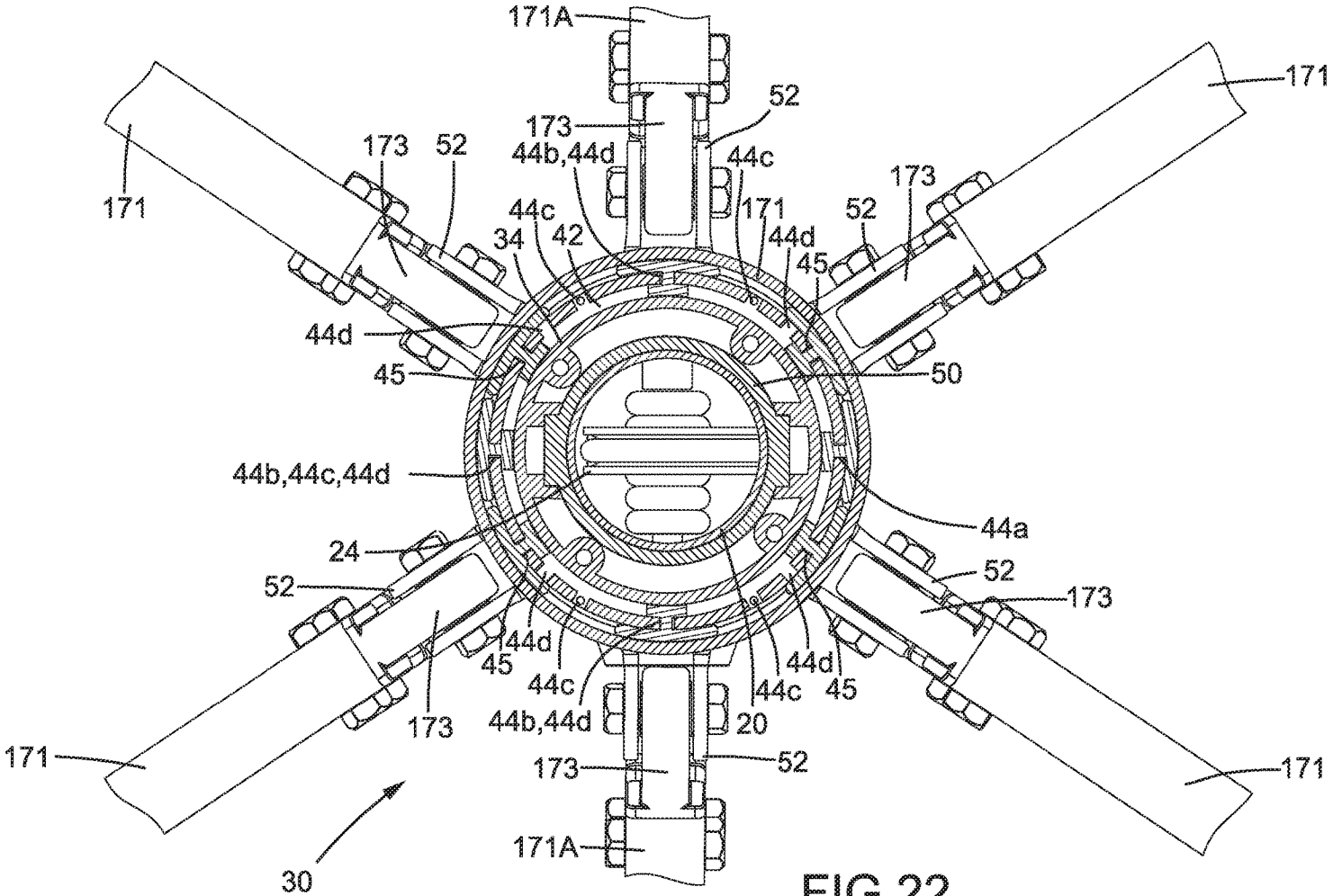
FIG. 22 is a cross sectional view taken along section line 22-22 of FIG. 21.

With reference to FIGS. 21 and 22, the umbrella 10 can be assembled to include six ribs 171 for supporting a rectangular canopy. Specifically, four rib seats 52 respectively engage with the four first upper fixing grooves 45 and respectively and pivotably connect with four ribs 171 to construct a contour for a rectangular canopy having two longer sides and two shorter sides. Furthermore, two of the plurality of first upper positioning grooves 44*a*-44*d* respectively associated with middle points of the two longer sides of the canopy are coupled with another two rib seats 52 (see FIG. 22). Furthermore, the fixed hub device 30 further includes two longer side ribs 171A. Each of the two longer side ribs 171A is substantially the same as each of the plurality of ribs 171 and has a length smaller than a length of each of the plurality of ribs 171 (see FIG. 21). Each of the two longer side ribs 171A is connected by a respective connecting member 175 with the pivotal end 157 of a respective one of another two stretchers 155. Six stretcher seats 98 are detachably coupled to the four first lower fixing grooves 91 and two of the plurality of first upper positioning grooves 90. The second pivotal ends 159 of the six stretchers 155 are respectively and pivotably connected to the six stretcher seats 98. Thus, the umbrella 10, when stretched open, includes six ribs 171 and six stretchers 155 to support a rectangular canopy (see FIG. 21).

Figure 23:
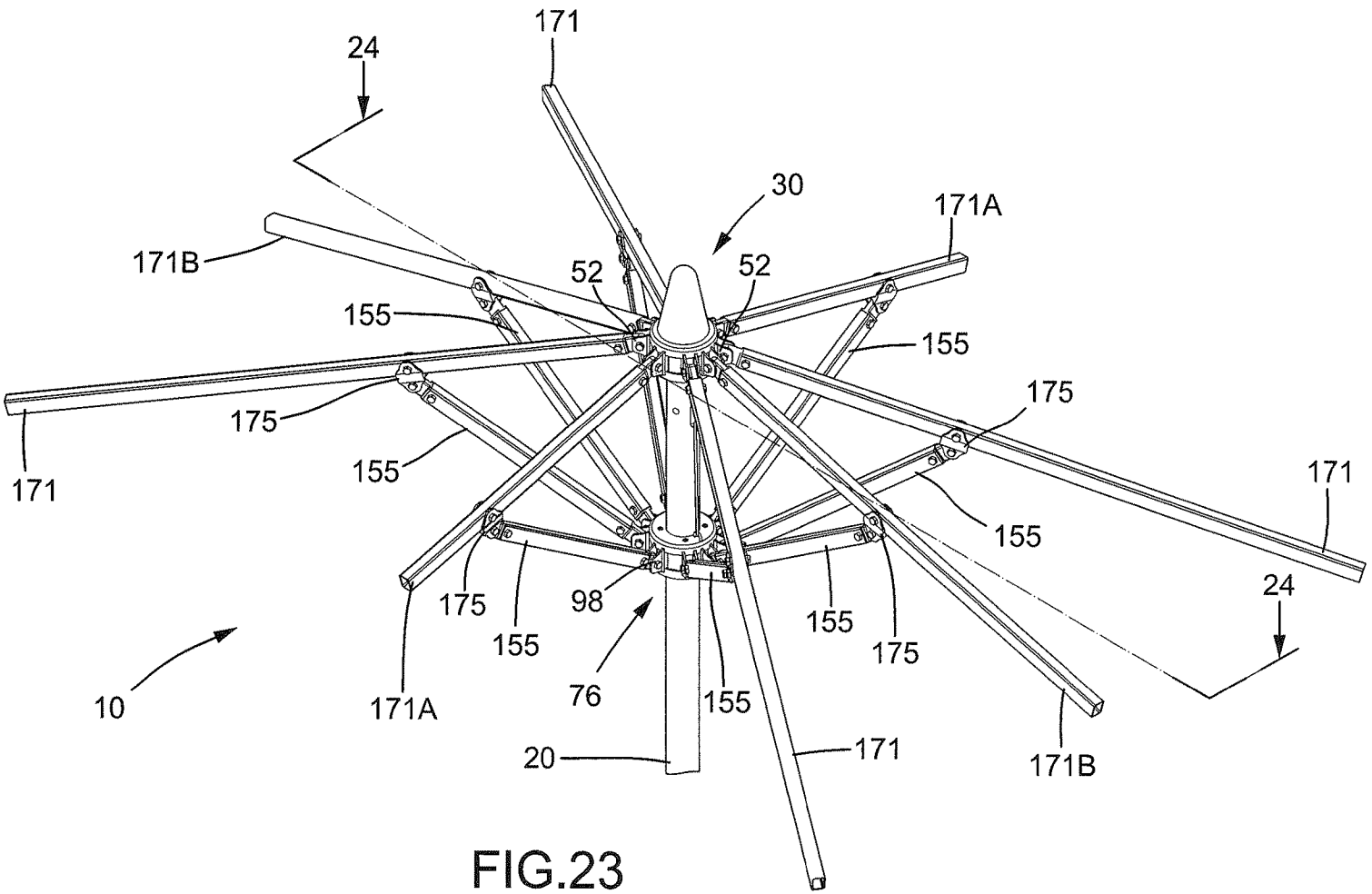
FIG. 23 is a perspective view of a modular umbrella of yet another example according to the present invention, with the modular umbrella including eight ribs for a rectangular canopy and being in a folded state.
Figure 24:
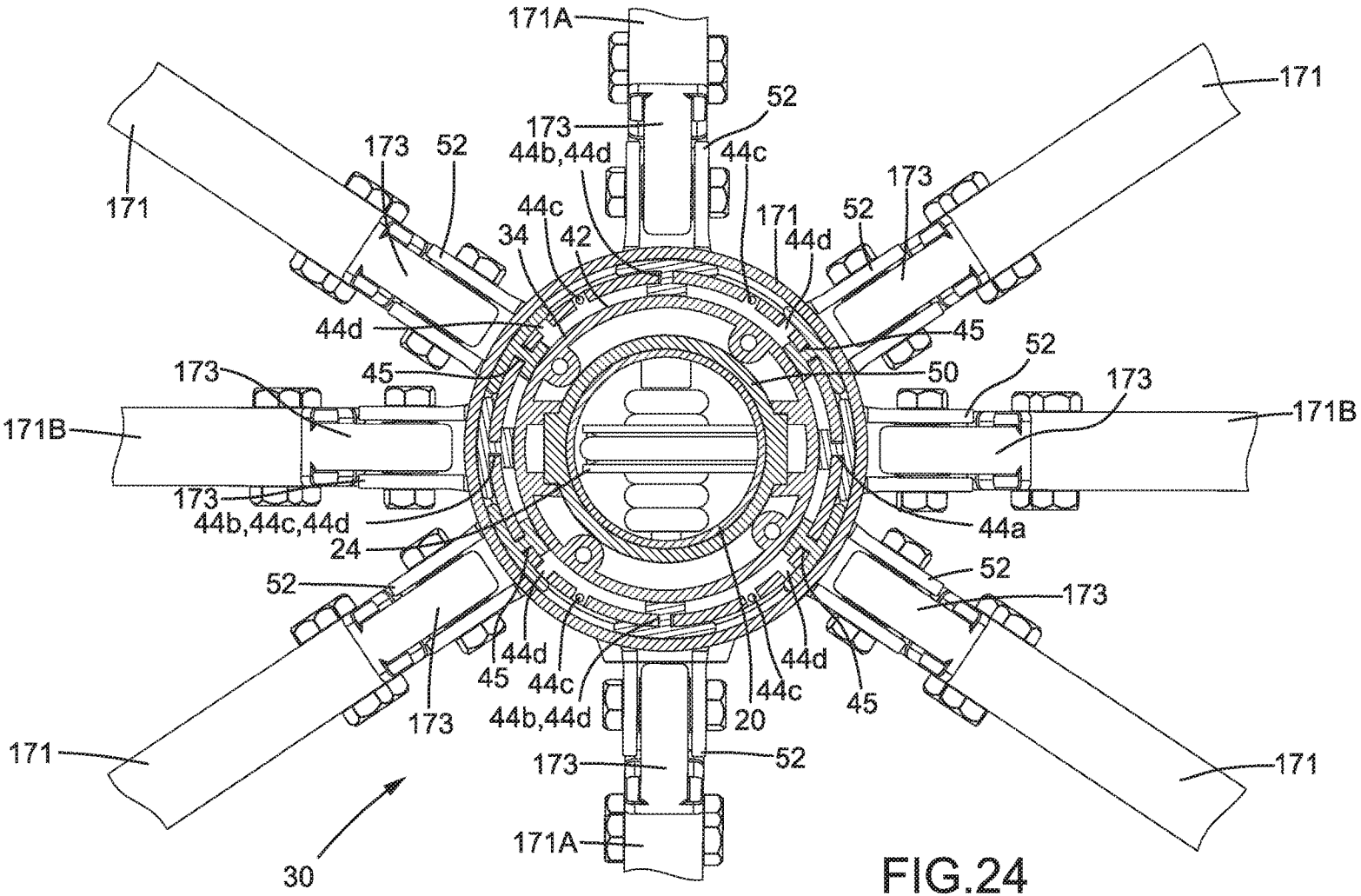
FIG. 24 is a cross sectional view taken along section line 24-24 of FIG. 23.

With reference to FIGS. 23 and 24, the umbrella 10 can be assembled to include eight ribs for supporting a rectangular canopy. Specifically, four rib seats 52 respectively engage with the four first upper fixing grooves 45 and respectively and pivotably connect with four ribs 171 to construct a contour for a rectangular canopy having two longer sides and two shorter sides. Furthermore, four of the plurality of first upper positioning grooves 44*a*-44*d* respectively associated with middle points of the two longer sides and the two shorter sides of the canopy are coupled with another four rib seats 52. Furthermore, the fixed hub device 30 further includes two longer side ribs 171A and two shorter side ribs 171B. Each of the two longer side ribs 171A is substantially the same as each of the plurality of ribs 171 and has a length smaller than a length of each of the plurality of ribs 171 (see FIG. 21). The two longer side ribs 171A are connected by two connecting members 175 to the pivotal ends 157 of two of the another four stretchers 155. The two shorter side ribs 171B are connected by another two connecting members 175 to the pivotal ends 157 of the other two of the another four stretchers 155. Eight stretcher seats 98 are detachably coupled to the four first lower fixing grooves 91 and four of the plurality of first lower positioning grooves 90. The second pivotal ends 159 of the eight stretchers 155 are respectively and pivotably connected to the eight stretcher seats 98. Thus, the umbrella 10, when stretched open, includes eight ribs 171, 171A and 171B, and eight stretchers 155 to support a rectangular canopy.

The upper coupling sleeve 32 and the lower coupling sleeve 78 of the umbrella 10 according to the present invention are configured to cooperate with a desired number (four, six, eight, etc.) of stretcher seats 52, a corresponding number of stretchers 155, and a corresponding number of ribs 171, 171A, 171B for supporting a square or rectangular canopy. Through provision of this modular design, the manufacturers do not have to manufacture various molds for the fixed hub device 30 and the runner device 76, further reducing the manufacturing cost.

When any one of the plurality of ribs 171 or any one of the plurality of stretchers 155 is broken, only the associated first engaging screw 175D or the associated second engaging screw 175E has to be detached to remove or repair the broken rib 171 or the broken stretcher 155, providing fast replacement or maintenance.

Now that the basic teachings of the present invention have been explained, many extensions and variations will be obvious to one having ordinary skill in the art. For example, the fixed hub device 30 does not have to include the plurality of first and second upper positioning grooves 44*a*-44*d* and 46 and the plurality of first and second upper fixing grooves 45 and 47. In this case, the selected rib seats 52 can be positioned by the first upper fixing member 72 and/or the second upper fixing member 74 (such as engagement between the selected rib seats 52 and positioning grooves defined in inner surfaces of the first and second upper fixing members 72 and 74). Alternatively, the runner device 76 does not have to include the plurality of first and second lower positioning grooves 90 and 92 and the plurality of first and second lower fixing grooves 91 and 93. In this case, the selected stretcher seats 98 can be positioned by the first lower fixing member 139 and/or the second lower fixing member 74 (such as engagement between the selected stretcher seats 98 and positioning grooves defined in inner surfaces of the first and second lower fixing members 139 and 153).

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A modular umbrella comprising:

a post including a top end;

an upper coupling sleeve fixed on the top end of the post, wherein the upper coupling sleeve including a plurality of first upper positioning grooves spaced from each other in a circumferential direction about a longitudinal axis of the post;

a plurality of rib seats, wherein each of the plurality of rib seats includes a first engaging portion and an upper lug, wherein some or all of the plurality of rib seats are selected and detachably couple with the upper coupling sleeve, wherein the first engaging portion of each of the selected ones of the plurality of rib seats engages with a respective one of the plurality of first upper positioning grooves of the upper coupling sleeve, and wherein the selected ones of the plurality of rib seats is spaced from each other in the circumferential direction about the longitudinal axis of the post;

a plurality of ribs, wherein each of the plurality of ribs includes a pivotal end pivotably connected to the upper lug of a respective one of the selected ones of the plurality of rib seats;

a lower coupling sleeve slideably mounted on the post and slideable along the longitudinal axis of the post, wherein the lower coupling sleeve includes a plurality of first lower positioning grooves respectively aligned with the plurality of first upper positioning grooves, wherein a number of the plurality of first lower positioning grooves is equal to a number of the plurality of first upper positioning grooves;

a plurality of stretcher seats, wherein each of the plurality of stretcher seats includes a first positioning portion and a lower lug, wherein some or all of the plurality of stretcher seats are selected and detachably couple with the lower coupling sleeve, and a number of the selected ones of the plurality of stretcher seats is equal to a number of the selected ones of the plurality of rib seats, wherein the first positioning portion of each of the selected ones of the plurality of stretcher seats engages with a respective one of the plurality of first lower positioning grooves, wherein the selected ones of the plurality of stretcher seats are spaced from each other in the circumferential direction about the longitudinal axis of the post and are respectively aligned with the selected ones of the plurality of rib seats; and a plurality of stretchers, wherein each of the plurality of stretchers includes a first pivotal end and a second pivotal end, wherein the first pivotal end of each of the plurality of stretchers is pivotably connected to a respective one of the plurality of ribs, wherein the second pivotal end of each of the plurality of stretchers is pivotably connected to the lower lug of a respective one of the selected ones of the plurality of stretcher seats, wherein the upper coupling sleeve includes a first end face, wherein the plurality of first upper positioning grooves is defined in the first end face of the upper coupling sleeve, wherein the plurality of first upper positioning grooves includes a first groove, a plurality of second grooves, a plurality of third grooves, and a plurality of optional fourth grooves, wherein the first groove and the plurality of second grooves are spaced from each other by a first annular regular interval, wherein the first groove and the plurality of third grooves are spaced from each other by a second annular regular interval different from the first annular regular interval, wherein the first groove and the plurality of optional fourth grooves are spaced from each other by a third annular regular interval different from the first and second annular regular intervals, wherein the lower coupling sleeve includes a top end face, and wherein the plurality of first lower positioning grooves is defined in the top end face of the lower coupling sleeve, and wherein the upper coupling sleeve further includes a second end face spaced from the first end face along the longitudinal axis of the post, wherein the upper coupling sleeve further includes a plurality of second upper positioning grooves defined in the second end face, wherein a number of the plurality of second upper positioning grooves is equal to the number of the first upper positioning grooves, wherein each of the plurality of rib seats further includes a second engaging portion, the second engaging portion of each of the selected ones of the plurality of rib seats engages with a respective one of the plurality of second upper positioning grooves, wherein the lower coupling sleeve further includes a bottom end face spaced from the top end face along the longitudinal axis of the post, wherein the lower coupling sleeve further includes a plurality of second lower positioning grooves defined in the bottom end face and respectively aligned with the plurality of first lower positioning grooves, wherein a number of the plurality of second lower positioning grooves is equal to the number of the plurality of first lower positioning grooves, wherein each of the plurality of stretcher seats further includes a second positioning portion, wherein the second positioning portion of each of the selected ones of the plurality of stretcher seats engage with a respective one of the plurality of second lower positioning grooves.

2. The modular umbrella as claimed in claim 1, wherein the first groove and the plurality of second grooves are spaced from each other by 90°, wherein the first groove and the plurality of third grooves are spaced from each other by 60°, and wherein the first groove and the plurality of optional fourth grooves are spaced from each other by 45°, wherein one of the plurality of second grooves spaced from the first groove by 180° is also one of the plurality of third grooves spaced from the first groove by 180° and is also one of the plurality of fourth grooves spaced from the first groove by 180°, wherein another one of the plurality of second grooves spaced from the first groove by 90° is also another one of the plurality of fourth grooves spaced from the first groove by 90°, and wherein a further one of the plurality of second grooves spaced from the first groove by 270° is also a further one of the plurality of fourth grooves spaced from the first groove by 270°.

3. The modular umbrella as claimed in claim 1, further comprising:

a plurality of connecting members, wherein each of the plurality of connecting members includes a first engaging portion, a second engaging portion, and an intermediate portion between the first engaging portion and the second engaging portion, wherein the first engaging portion of each of the plurality of connecting members receives a respective one of the plurality of ribs, and wherein the second engaging portion of each of the plurality of connecting members is pivotably connected to the first pivotal end of a respective one of the plurality of stretchers;

a plurality of first engaging screws, wherein each of the plurality of engaging screws is detachably coupled to the first engaging portion of a respective one of the plurality of connecting members and fixes a respective one of the plurality of ribs to the first engaging portion; and a plurality of second engaging screws, wherein each of the plurality of second engaging screws is detachably coupled to the second engaging portion of a respective one of the plurality of connecting members and pivotably connects the first pivotal end of a respective one of the plurality of stretchers to the second engaging portion.

4. A modular umbrella comprising:

a post including a top end;

an upper coupling sleeve fixed on the top end of the post, wherein the upper coupling sleeve including a plurality of first upper positioning grooves spaced from each other in a circumferential direction about a longitudinal axis of the post;

a plurality of rib seats, wherein each of the plurality of rib seats includes a first engaging portion and an upper lug, wherein some or all of the plurality of rib seats are selected and detachably couple with the upper coupling sleeve, wherein the first engaging portion of each of the selected ones of the plurality of rib seats engages with a respective one of the plurality of first upper positioning grooves of the upper coupling sleeve, and wherein the selected ones of the plurality of rib seats is spaced from each other in the circumferential direction about the longitudinal axis of the post;

a plurality of ribs, wherein each of the plurality of ribs includes a pivotal end pivotably connected to the upper lug of a respective one of the selected ones of the plurality of rib seats;

a lower coupling sleeve slideably mounted on the post and slideable along the longitudinal axis of the post, wherein the lower coupling sleeve includes a plurality of first lower positioning grooves respectively aligned with the plurality of first upper positioning grooves, wherein a number of the plurality of first lower positioning grooves is equal to a number of the plurality of first upper positioning grooves;

a plurality of stretcher seats, wherein each of the plurality of stretcher seats includes a first positioning portion and a lower lug, wherein some or all of the plurality of stretcher seats are selected and detachably couple with the lower coupling sleeve, and a number of the selected ones of the plurality of stretcher seats is equal to a number of the selected ones of the plurality of rib seats, wherein the first positioning portion of each of the selected ones of the plurality of stretcher seats engages with a respective one of the plurality of first lower positioning grooves, wherein the selected ones of the plurality of stretcher seats are spaced from each other in the circumferential direction about the longitudinal axis of the post and are respectively aligned with the selected ones of the plurality of rib seats; and a plurality of stretchers, wherein each of the plurality of stretchers includes a first pivotal end and a second pivotal end, wherein the first pivotal end of each of the plurality of stretchers is pivotably connected to a respective one of the plurality of ribs, wherein the second pivotal end of each of the plurality of stretchers is pivotably connected to the lower lug of a respective one of the selected ones of the plurality of stretcher seats, wherein the upper coupling sleeve includes a first end face, wherein the plurality of first upper positioning grooves is defined in the first end face of the upper coupling sleeve, wherein the plurality of first upper positioning grooves includes a first groove, a plurality of second grooves, a plurality of third grooves, and a plurality of optional fourth grooves, wherein the first groove and the plurality of second grooves are spaced from each other by a first annular regular interval, wherein the first groove and the plurality of third grooves are spaced from each other by a second annular regular interval different from the first annular regular interval, wherein the first groove and the plurality of optional fourth grooves are spaced from each other by a third annular regular interval different from the first and second annular regular intervals, wherein the lower coupling sleeve includes a top end face, and wherein the plurality of first lower positioning grooves is defined in the top end face of the lower coupling sleeve, and wherein the first engaging portion of each of the plurality of rib seats includes a first portion and a second portion larger than the first portion, wherein the upper coupling sleeve further includes a coupling groove defined in the first end face and intercommunicating with the plurality of first upper positioning grooves, wherein the first portion of each of the selected ones of the plurality of rib seats is received in a respective one of the plurality of first upper positioning grooves, wherein the second portion of each of the selected ones of the plurality of rib seats is received in the coupling groove, wherein the first positioning portion of each of the plurality of stretcher seats includes a narrower portion and a wider portion that is larger than the narrower portion, wherein the lower coupling sleeve includes an insertion groove defined in the top end face and intercommunicating with the plurality of first lower positioning groove, wherein the narrower portion of each of the selected ones of the plurality of stretcher seats is received in a respective one of the plurality of first lower positioning grooves, and wherein the wider portion of each of the selected ones of the plurality of stretcher seats is received in the insertion groove.

5. A modular umbrella further comprising:

a post including a top end;

an upper coupling sleeve fixed on the top end of the post, wherein the upper coupling sleeve including a plurality of first upper positioning grooves spaced from each other in a circumferential direction about a longitudinal axis of the post;

a plurality of rib seats, wherein each of the plurality of rib seats includes a first engaging portion and an upper lug, wherein some or all of the plurality of rib seats are selected and detachably couple with the upper coupling sleeve, wherein the first engaging portion of each of the selected ones of the plurality of rib seats engages with a respective one of the plurality of first upper positioning grooves of the upper coupling sleeve, and wherein the selected ones of the plurality of rib seats is spaced from each other in the circumferential direction about the longitudinal axis of the post;

a plurality of ribs, wherein each of the plurality of ribs includes a pivotal end pivotably connected to the upper lug of a respective one of the selected ones of the plurality of rib seats;

a lower coupling sleeve slideably mounted on the post and slideable along the longitudinal axis of the post, wherein the lower coupling sleeve includes a plurality of first lower positioning grooves respectively aligned with the plurality of first upper positioning grooves, wherein a number of the plurality of first lower positioning grooves is equal to a number of the plurality of first upper positioning grooves;

a plurality of stretcher seats, wherein each of the plurality of stretcher seats includes a first positioning portion and a lower lug, wherein some or all of the plurality of stretcher seats are selected and detachably couple with the lower coupling sleeve, and a number of the selected ones of the plurality of stretcher seats is equal to a number of the selected ones of the plurality of rib seats, wherein the first positioning portion of each of the selected ones of the plurality of stretcher seats engages with a respective one of the plurality of first lower positioning grooves, wherein the selected ones of the plurality of stretcher seats are spaced from each other in the circumferential direction about the longitudinal axis of the post and are respectively aligned with the selected ones of the plurality of rib seats;

a plurality of stretchers, wherein each of the plurality of stretchers includes a first pivotal end and a second pivotal end, wherein the first pivotal end of each of the plurality of stretchers is pivotably connected to a respective one of the plurality of ribs, wherein the second pivotal end of each of the plurality of stretchers is pivotably connected to the lower lug of a respective one of the selected ones of the plurality of stretcher seats, a first upper fixing member, wherein each of the plurality of rib seats further includes a base having an inner surface on which the first engaging portion is disposed and an outer surface on which the upper lug is disposed, wherein the upper coupling sleeve includes a first end face and a second end face, wherein the first upper fixing member is fixed on the first end face and secures a top end of the base of each of the selected ones of the plurality of rib seats;

a second upper fixing member fixed on the second end face of the upper coupling sleeve and securing a lower end of the base of each of the selected ones of the plurality of rib seats;

a first lower fixing member, wherein each of the plurality of stretchers seats further includes a body having an inner side on which the first positioning portion is disposed and an outer side on which the lower lug is disposed, wherein the lower coupling sleeve includes a top end face and a bottom end face, wherein the first lower fixing member is fixed on the top end face of the lower coupling sleeve and secures a top end of the body of each of the selected ones of the plurality of stretcher seats; and a second lower fixing member, wherein the second lower fixing member is fixed on the bottom end face of the lower coupling sleeve and secures a bottom end of the body of each of the selected ones of the plurality of stretchers seats.

6. The modular umbrella as claimed in claim 5, wherein the upper coupling sleeve includes a first end face, wherein the plurality of first upper positioning grooves is defined in the first end face of the upper coupling sleeve, wherein the plurality of first upper positioning grooves includes a first groove, a plurality of second grooves, a plurality of third grooves, and a plurality of optional fourth grooves, wherein the first groove and the plurality of second grooves are spaced from each other by a first annular regular interval, wherein the first groove and the plurality of third grooves are spaced from each other by a second annular regular interval different from the first annular regular interval, wherein the first groove and the plurality of optional fourth grooves are spaced from each other by a third annular regular interval different from the first and second annular regular intervals, wherein the lower coupling sleeve includes a top end face, and wherein the plurality of first lower positioning grooves is defined in the top end face of the lower coupling sleeve.

7. A modular umbrella comprising:

a post including a top end;

a fixed hub device fixed on the top end of the post, wherein the fixed hub device includes a plurality of rib seats, a first upper fixing member, and a second upper fixing member spaced from the first upper fixing member along a longitudinal axis of the post, wherein at least one of the first upper fixing member and the second upper fixing member is detachably mounted, and wherein some or all of the plurality of rib seats are selected and detachably mounted between the first upper fixing member and the second upper fixing member;

a plurality of ribs, wherein each of the plurality of ribs is pivotably connected to a respective one of the selected ones of the plurality of rib seats;

a runner device mounted on the post and slideable along the longitudinal axis of the post, wherein the runner device includes a plurality of stretcher seats, a first lower fixing member, and a second lower fixing member spaced from the first lower fixing member along the longitudinal axis of the post, wherein at least one of the first lower fixing member and the second lower fixing member is detachably mounted, wherein some or all of the plurality of stretcher seats are detachably mounted between the first lower fixing member and the second lower fixing member, wherein a number of the selected ones of the plurality of stretcher seats is equal to a number of the selected ones of the plurality of rib seats; and a plurality of stretchers, wherein each of the plurality of stretchers includes a first pivotal end and a second pivotal end, wherein the first pivotal end of each of the plurality of stretchers is pivotably connected to a respective one of the plurality of ribs, and wherein the second pivotal end of each of the plurality of stretchers is pivotably connected to a respective one of the selected ones of the plurality of stretcher seats, wherein the fixed hub device further includes two longer side ribs, wherein each of the two longer side ribs has a length smaller than a length of each of the plurality of ribs, wherein the fixed hub device includes an upper coupling sleeve fixed on the top end of the post, wherein the upper coupling sleeve includes a plurality of first upper positioning grooves and four first upper fixing grooves spaced from the plurality of first upper positioning grooves in the circumferential direction about the longitudinal axis of the post, wherein the plurality of first upper positioning grooves includes a first groove, a plurality of second grooves, a plurality of third grooves, and a plurality of fourth grooves, wherein the first groove and the plurality of second grooves are spaced from each other by 90°, wherein the first groove and the plurality of third grooves are spaced from each other by 60°, wherein the first groove and the plurality of fourth grooves are spaced from each other by 45°, wherein one of the plurality of second grooves spaced from the first groove by 180° is also one of the plurality of third grooves spaced from the first groove by 180° and is also one of the plurality of fourth grooves spaced from the first groove by 180°, wherein another one of the plurality of second grooves spaced from the first groove by 90° is also another one of the plurality of fourth grooves spaced from the first groove by 90°, and wherein a further one of the plurality of second grooves spaced from the first groove by 270° is also a further one of the plurality of fourth grooves spaced from the first groove by 270°; wherein each of the plurality of rib seats includes a first engaging portion on the base thereof, wherein the first engaging portion of each of the selected ones of the plurality of rib seats engages with a respective one of the first upper positioning grooves of the upper coupling sleeve and/or four of the plurality of rib seats engage with the four first upper fixing grooves, wherein the runner device includes a plurality of first lower positioning grooves respectively aligned with the plurality of first upper positioning grooves, wherein a number of the plurality of first lower positioning grooves is equal to a number of the plurality of first upper positioning grooves, wherein the runner device further includes four first lower fixing grooves spaced from the plurality of first lower positioning grooves in the circumferential direction of the longitudinal axis of the post and respectively aligned with the four first upper fixing grooves, wherein when four of the plurality of rib seats are selected and detachably engage with the first groove and the plurality of second grooves spaced from each other by 90°, four of the plurality of stretcher seats are selected and respectively and detachably couple with the first groove and the plurality of second grooves, wherein when six of the plurality of rib seats are selected and detachably engage with the first groove and the plurality of third grooves spaced from each other by 60°, six of the plurality of stretcher seats are selected and respectively and detachably couple with six of the plurality of first lower positioning grooves respectively aligned with the first groove and the plurality of third grooves, wherein when eight of the plurality of rib seats are selected and detachably engage with the first groove and the plurality of fourth grooves spaced from each other by 45°, eight of the plurality of stretcher seats are selected and respectively and detachably couple with eight of the plurality of first lower positioning grooves respectively aligned with the first groove and the plurality of fourth grooves, wherein when four of the plurality of rib seats are selected and detachably engage with the four first upper fixing grooves, four of the plurality of stretcher seats are selected and respectively and detachably couple with the four first lower fixing grooves, and wherein when four of the plurality of rib seats are selected and detachably engage with the four first upper fixing grooves and another two of the plurality of rib seats are selected and detachably engage with two of the plurality of first upper positioning grooves, four of the plurality of stretcher seats are selected to respectively and detachably couple with the four first lower fixing grooves, another two of the plurality of stretcher seats are selected and respectively and detachably couple with two of the plurality of first lower positioning grooves aligned with the two of the plurality of first upper positioning grooves, and wherein the two longer side ribs are respectively and pivotably connected to the another two of the plurality of rib seats.

8. The modular umbrella as claimed in claim 7, wherein the fixed hub device further includes an upper coupling sleeve fixed on the top end of the post, wherein the upper coupling sleeve includes a first end face and a second end face, wherein each of the plurality of rib seats further includes a base, wherein the first upper fixing member is fixed on the first end face and secures a top end of the base of each of the selected ones of the plurality of rib seats, wherein the second upper fixing member is fixed on the second end face of the upper coupling sleeve and secures a bottom end of the base of each of the selected ones of the plurality of rib seats, wherein the runner device further includes a lower coupling sleeve having a top end face and a bottom end face, wherein each of the plurality of stretcher seats further includes a body, wherein the first lower fixing member is fixed on the top end face of the lower coupling sleeve and secures a top end of the body of each of the selected one of the plurality of stretcher seats, and wherein the second lower fixing member is fixed on the bottom end face of the lower coupling sleeve and secures a bottom end of the body of each of the selected ones of the plurality of stretchers seats.

9. The modular umbrella as claimed in claim 8, wherein the plurality of rib seats includes four, six, or eight rib seats spaced from each other by an annular regular interval.

10. The modular umbrella as claimed in claim 7, further comprising two shorter side ribs, wherein each of the two shorter side ribs has a length larger than the length of each of the two longer side ribs and shorter than the length of each of the plurality of ribs, wherein further two of the plurality of rib seats are selected and detachably engage with further two of the plurality of first upper positioning grooves, wherein the two short side ribs are respectively and pivotably connected to the further two of the plurality of rib seats, wherein further two of the plurality of stretcher seats are selected and detachably engage with two of the four first lower fixing grooves that are aligned with the further two of the plurality of rib seats pivotably connected to the two shorter side ribs, and wherein each of another two of the plurality of stretchers are respectively and pivotably connected between one of the two shorter side ribs and one of the further two of the plurality of stretcher seats.

* * * * *